US011492762B2

(12) United States Patent
Janson

(10) Patent No.: US 11,492,762 B2
(45) **Date of Patent: *Nov. 8, 2022**

(54) RAIL TIE PLATE WITH SPIKE RETENTION CAPABILITY

(71) Applicant: Paul M. Janson, Porter Ranch, CA (US)

(72) Inventor: Paul M. Janson, Porter Ranch, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/719,935

(22) Filed: Apr. 13, 2022

(65) Prior Publication Data

US 2022/0243404 A1 Aug. 4, 2022

Related U.S. Application Data

(63) Continuation of application No. 17/503,297, filed on Oct. 16, 2021, now Pat. No. 11,359,335.

(60) Provisional application No. 63/204,697, filed on Oct. 19, 2020.

(51) Int. Cl.
*E01B 9/12* (2006.01)
*E01B 9/06* (2006.01)

(52) U.S. Cl.
CPC . *E01B 9/12* (2013.01); *E01B 9/06* (2013.01)

(58) Field of Classification Search
CPC ..... E01B 9/06; E01B 9/12
See application file for complete search history.

(56) References Cited

U.S. PATENT DOCUMENTS

| | | | | |
|---|---|---|---|---|
| 457,584 | A | 8/1891 | Goldie | |
| 1,511,548 | A | 10/1924 | Rutherford | |
| 1,646,630 | A | 10/1927 | Rocco | |
| 2,035,885 | A | 3/1936 | Hojnowski | |
| 2,299,308 | A | 10/1942 | Creighton | |
| 2,629,557 | A * | 2/1953 | Rosenberg | E01B 9/12 238/294 |
| 3,429,506 | A | 2/1969 | Triplett | |
| 4,141,500 | A | 2/1979 | Gragnani | |
| 4,350,291 | A | 9/1982 | Dobson | |

(Continued)

FOREIGN PATENT DOCUMENTS

| | | | |
|---|---|---|---|
| DE | 202007018602 | U1 | 12/2008 |
| EP | 1948865 | A1 | 7/2008 |

*Primary Examiner* — Robert J McCarry, Jr.
(74) *Attorney, Agent, or Firm* — Brian S. Steinberger; Hilary F. Steinberger; Law Offices of Brian S. Steinberger, P.A.

(57) ABSTRACT

Apparatus, devices, assemblies, systems and methods of using w spring clips over spikes for holding railroad tie spikes down to wood and concrete railroad ties and hold the spike heads to the rails. A first embodiment can use rail tie plates with box holders for holding end portions of a w shaped spring steel clip to press against cap heads of railroad tie spikes. A second embodiment can use a rail tie plates with vertical supports for horizontal bars over heads of railroad tie spikes. A third embodiment can use rail tie plates with vertical studs and upper threaded ends with flat plates attached by nuts over heads of rail road tie spikes, and with cotter pins locking the nuts in place. Additional embodiments include metal structures fastened, welded and/or forged to tie plates for allowing w shaped spring clips with mid portions that hold down heads on spikes to prevent the spikes from coming out.

18 Claims, 18 Drawing Sheets

(56) References Cited

U.S. PATENT DOCUMENTS

| | | | |
|---|---|---|---|
| 4,461,422 | A | 7/1984 | Harkus |
| 4,513,912 | A | 4/1985 | Schumaker |
| 4,756,477 | A | 7/1988 | Schumaker |
| 4,953,787 | A | 9/1990 | Fee |
| 5,520,330 | A | 5/1996 | Brown et al. |
| 6,808,120 | B2 | 10/2004 | Oram et al. |
| D776,004 | S | 1/2017 | Pisano |
| 11,124,922 | B1 | 9/2021 | Janson |
| 11,359,335 | B2 * | 6/2022 | Janson ..... E01B 9/06 |
| 2005/0036852 | A1 | 2/2005 | Berna |
| 2010/0224691 | A1 | 9/2010 | McQuistian |
| 2010/0301126 | A1 | 12/2010 | Meyer |
| 2013/0004705 | A1 | 1/2013 | Jaffe |
| 2014/0103132 | A1 | 4/2014 | Lienhard et al. |
| 2015/0033663 | A1 | 2/2015 | Kunz et al. |
| 2016/0298299 | A1 | 10/2016 | Hamilton et al. |
| 2018/0058012 | A1 | 3/2018 | Coats |
| 2021/0277608 | A1 | 9/2021 | Nguyen |

* cited by examiner

RAIL TIE PLATE WITH SPIKE RETENTION CAPABILITY

CROSS REFERENCE TO RELATED APPLICATIONS

This application is a Continuation of U.S. patent application Ser. No. 17/503,297 filed Oct. 16, 2021, now U.S. Pat. No. 11,359,335, which claims the benefit of priority to U.S. Provisional Application Ser. No. 63/204,697 filed Oct. 19, 2020, which is incorporated herein by specific reference thereto. The entire disclosure of each of the applications listed in this paragraph are incorporated herein by specific reference thereto.

FIELD OF INVENTION

This invention relates to railroad tie spikes, and in particular to apparatus, devices, assemblies, systems and methods of using clips over spikes for holding railroad tie spikes down to wood and concrete railroad ties and hold the spike heads to the rails.

BACKGROUND AND PRIOR ART

Trains run on rails supported on cross ties formed of wood. The rails are commonly made of a steel, and have mounting flanges. The mounting flanges are adapted to rest on metallic bearing plates, generally referred to as tie plates or fishplates. The fishplates rest on the wooden ties, and spikes are used for securing rails to wooden ties. Spikes are often inserted in an opening or cavity in the fishplate and the spike shank is driven into the tie. The head of the spike is generally adapted to engage with the flange of the rail, thereby securing the rail to the tie. Alternatively, the tie plates or fish plates are equipped with a metal clip or boss that engages to the flange of the rail, and the head of the spike is adapted to engage with the fishplate to secure the rail to the tie. See for example, U.S. Pat. No. 457,584 to Goldie; U.S. Pat. No. 4,141,500 to Gragnani; U.S. Pat. No. 4,350,291 to Dobson; U.S. Pat. No. 4,461,422 to Harkus; U.S. Pat. Nos. 4,513,912 and 4,756,477 to Schumaker and U.S. Pat. No. 6,808,120 to Oram et al.

FIG. 1 is an upper perspective exploded view of a prior art assembly 1 of spikes 2, 4, 6, 8 about to be attached through holes 13, 15 in a rail tie plate 10 to hold down a rail 20 to a rail tie 30. The side flanges of the rail 20 are positioned between the first ridge 12 and the second ridge 16 on top of the rail tie plate 10.

FIG. 2 is an upper perspective assembled view of the assembly 1 of FIG. 1 with spikes 2, 4 attached through a rail tie plate 10 holding a rail 20 to a rail tie 30. spikes 6, 8, not shown on the other side of the rail 20 also are driven into holes (not shown) in the rail tie plate 10 to hold the rail 20 to the rail tie 30.

Further attempts to secure or anchor a spike have included threaded spikes, and the like. See for example, U.S. Pat. No. 6,808,120 to Oram et al., Over time the ordinary spikes often work loose from the tie due to the working action that occurs as the rail deflects under the load and vibration of passing trains and due to expansion and contraction of the wood fibers of the tie due to temperature, humidity and other environmental changes. The loosening of the spikes will necessitate replacement of the spikes or other parts of the track assembly.

Furthermore, after such spikes have been in service an appreciable length of time, they will have a tendency to work in the hole established in the tie by the spike shank. Working of the spike acts to enlarge the hole surrounding the shank and to damage the surrounding wood fibers, causing the spike to loosen over time. The enlarged hole may also permit water and other chemicals to enter the hole surrounding the spike shank, thereby further weakening the spike or the surrounding wood fibers. Removal of the spikes usually causes additional damage to the ties. As such, spike removal often requires replacement of the entire tie in order to ensure that the replacement spike will anchor the rail to the tie with sufficient holding power.

The prior art does not describe, simple and effective techniques for protecting the spike heads from popping up from the ties over time to correct for the above discussed problems Thus, the need exists for solutions to the above problems with the prior art.

SUMMARY OF THE INVENTION

A primary objective of the present invention is to provide apparatus, devices, assemblies, systems and methods of using clips over spikes for holding railroad tie spikes down to wooden ties and concrete ties and hold the spike heads to the rail so that the spikes will not come out.

A secondary objective of the present invention is to provide apparatus, devices, assemblies, systems and methods of using clips over spikes for retaining railroad tie spikes to railroad ties by w spring clips which press against the top of the head of the rail spikes and can be locked in place.

A third objective of the present invention is to provide apparatus, devices, assemblies, systems and methods of using clips over spikes for retaining railroad tie spikes to railroad ties by w spring clips which press against the top of the head of the rail spikes and can be locked in place.

A fourth objective of the present invention is to provide apparatus, devices, assemblies, systems and methods of using tie plates with vertical brackets having through-holes for passing horizontal rods held in place with cotter pins for retaining heads of spikes from coming out of railroad ties.

A fifth objective of the present invention is to provide apparatus, devices, assemblies, systems and methods of using tie plates with vertical studs having threaded ends for allowing flat plates to be attached, and through-holes in the studs for cotter pins, in order to retain spikes from coming out of railroad ties.

A first embodiment of a railroad spike retention system for retaining spikes to rail ties, can include a tie plate with spaced apart parallel first and second raised ridges for positioning a rail to a rail tie, a first plurality of holders fixed to the tie plate adjacent to an outer side of the first raised ridge on the tie plate, a first plurality of w shaped spring clips, each with free ends and a loop mid portion, the free ends and the loop mid portion facing in a same direction, wherein the free ends of each first w shaped spring clip are inserted into the first plurality of holders and the mid portion of each first spring clip is positioned over head portions of a first set of side spikes for retaining the first set of side spikes in place, a second plurality of holders fixed to the tie plate adjacent to an outer side of the second raised ridge on the tie plate, and a second plurality of W shaped spring clips, each with free ends and a loop mid portion, the free ends and the loop mid portion facing in a same direction, wherein the free ends of each second W shaped spring clip are inserted into the second plurality of holders and the mid portion of each second spring clip is positioned over head portions of a second set of side spikes for retaining the second set of side spikes in place.

The first plurality of holders can include first box shapes attached to a first base plate attached to the outer side of the first raised ridge of the tie plate, and the second plurality of holders include second box shapes attached to the outer side of the second raised ridge of the tie plate.

The plurality of first holders can be welded to the first base plate which are welded to the outer side of the first raised ridge of the tie plate, and the plurality of second holders can be welded to the second base plate which are welded the outer side of the second raised ridge of the tie plate.

The first plurality of holders can include four holders in a row, the first side spike can be a pair of first side spikes, the second plurality of holders can include four holders in a row, and the second side spike can be a pair of second side spikes.

The first w shaped spring clip can include a first pair of w shaped spring clips with the mid portions of each of first w shaped spring clips for holding down heads of the pair of spikes, and wherein the second w shaped spring clip can include a second pair of w shaped spring clips for holding down heads of the second pair of spikes.

The first w shaped spring clip and the second w shaped spring clip can be steel clips.

The railroad spike retention system can include first pins for locking the free ends of each first w shaped spring clip to the first plurality of holders, and second pins for locking the free ends of each second w shaped spring clip to the second plurality of holders The first pins and the second pins can include cotter pins.

A method of retaining spikes in railroad ties, can include the steps of mounting a first plurality of holders fixed to the tie plate adjacent to an outer side of a first raised ridge. mounting a second plurality of holders fixed to the tie plate adjacent to an outer side of a second raised ridge. positioning the tie plate with the mounted first and second plurality of holders on a rail tie below a rail so that the rail is between the first raised ridge and the second raised ridge on the tie plate, attaching flange ridges of the rail to a rail tie with first and second sets of spikes, providing a set of first w shaped spring clips, each with free ends and a loop mid portion, the free ends and the loop mid portion facing in a same direction, inserting the free ends of each of the first set of w shaped spring clips into the first plurality of holders, positioning the mid portion of each of the first spring clips over head portions of the first set of spikes for retaining the first set of spikes in place in place to the rail tie, providing a set of second w shaped spring clips, each with free ends and a loop mid portion, the free ends and the loop mid portion facing in a same direction, inserting the free ends of each of the second set of w shaped spring clips into the second plurality of holders, and positioning the mid portion of each of the second spring clips is over head portions of the second set pf spikes for retaining the second set of spikes in place to the rail tie.

The method can include the steps of locking the free ends of the first w shaped spring clips to the first plurality of holders with first cotter pins, and locking the free ends of the second w shaped spring clips to the second plurality of holders with second cotter pins A second embodiment of a railroad spike retention system for retaining spikes to rail ties, can include a tie plate with spaced apart parallel first and second raised ridges for positioning a rail to a rail tie, first spaced apart vertical brackets fixed to the tie plate adjacent to the first raised ridge, each of the first brackets having an upper through-hole passing from one side to an opposite side, each upper through-hole above heads of first rail spikes, a first elongated rod being inserted through each upper through-hole in the vertical brackets over the top of the spikes to retain the first spikes from coming out, second spaced apart vertical brackets fixed to the tie plate adjacent to the second raised ridge, each of the second brackets having an upper through-hole passing from one side to an opposite side, each upper through-hole above heads of second rail spike, and a second elongated rod being inserted through each upper through-hole in the vertical brackets over the top of the spikes to retain the second spikes from coming out The railroad spike retention system can include first cotter pins for passing through through-holes in ends of the first elongated rod for locking the first elongated rod to the first vertical brackets, and second cotter pins for passing through through-holes in ends of the second elongated rod for locking the second elongated rod to the second vertical brackets.

A third embodiment of a railroad spike retention system for retaining spikes to rail ties, can include a tie plate with spaced apart parallel first and second raised ridges for positioning a rail to a rail tie, first spaced apart studs with threaded ends fixed to the tie plate adjacent to the first raised ridge, each of the first studs having an upper through-hole passing from one side to an opposite side, each upper through-hole above heads of first spikes, a first flat plate attached to the threaded ends of the first studs over the top of the first spikes to retain the first spikes from coming out, second spaced apart studs with threaded ends fixed to the tie plate adjacent to the second raised ridge, each of the second studs having an upper through-hole passing from one side to an opposite side, each upper through-hole above heads of second spikes, and a second flat plate attached to the threaded ends of the second studs over the top of the second spikes to retain the second spikes from coming out;

The railroad spike retention system can include nuts with washers and/or without first cotter pins for passing through the through-holes in the first studs for locking the first flat plate to the first studs, and nuts with washers and/or second cotter pins for passing through the through-holes in the second studs for locking the second flat plate to the second studs.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

DESCRIPTION OF THE PREFERRED EMBODIMENTS

Figure 1:
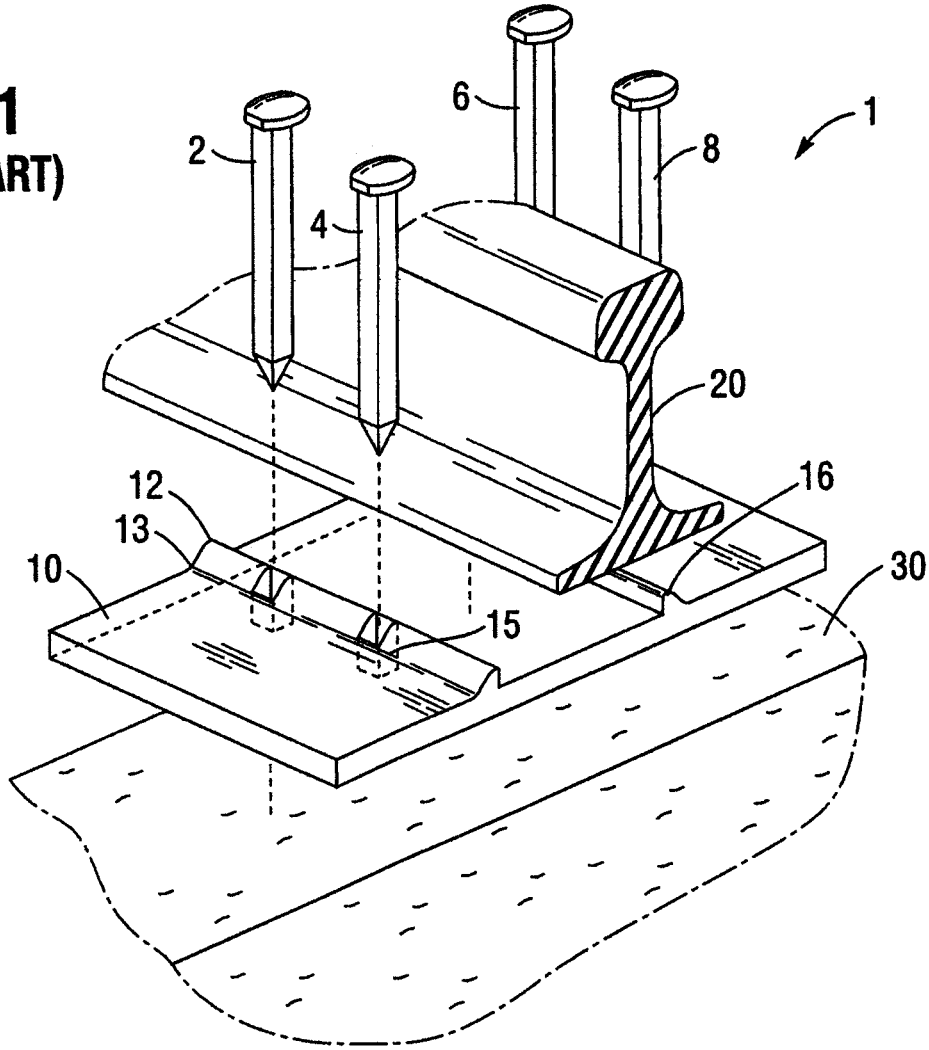
FIG. 1 (PRIOR ART)
FIG. 1 is an upper perspective exploded view of a prior art assembly of a spikes about to be attached to a rail tie plate to hold down a rail to a rail tie.
Figure 2:
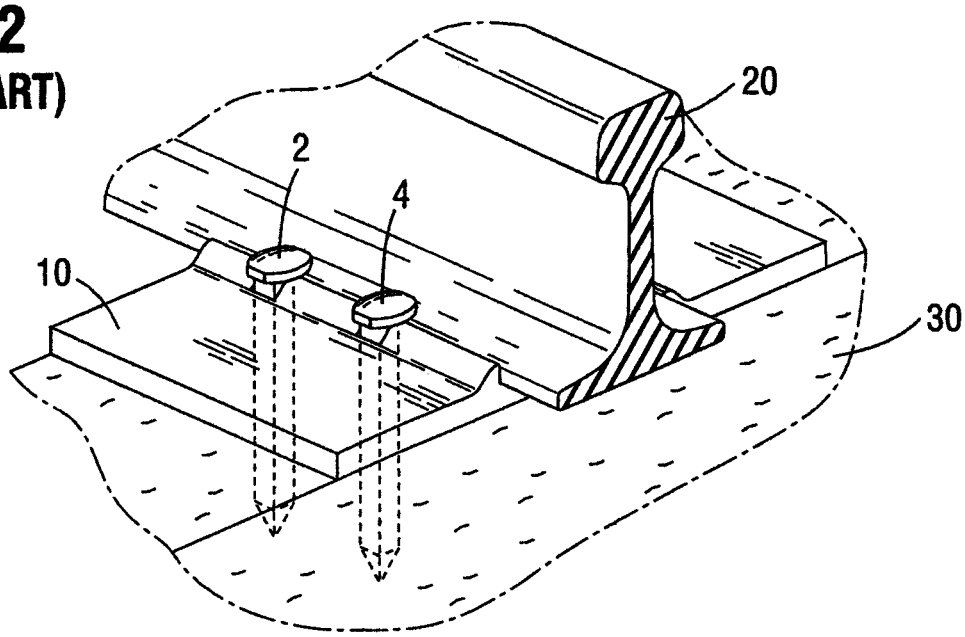
FIG. 2 (PRIOR ART)
FIG. 2 is an upper perspective assembled view of FIG. 1 with spikes attached through a rail tie plate holding a rail to a rail tie.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

A list of components will now be described.

1 Prior Art View of spikes attached to rail tie plate to hold rail to rail tie
2 spike
4 spike
6 spike
8 spike
10 Rail tie plate
12 first ridge
13 first hole
15 second hole
16 second ridge
20 Rail
30 rail tie
100 First Embodiment Rail Tie Plate with Holders for w Shaped Spring Clips
110 rail tie plate
112 first elongated ridge
113 first spike hole
115 second spike hole
116 second elongated ridge
117 third spike hole
119 fourth spike hole
120 left base plate
122 first left holder(box)
123 side openings for cotter pin
124 second left holder(box)
125 side openings for cotter pin
126 third left holder(box)
127 side openings for cotter pin
128 fourth left holder(box)
129 side openings for cotter pin
130 right base plate
132 first right holder(box)
133 side openings for cotter pin
134 second right holder(box)
135 side openings for cotter pin
136 third right holder(box)
137 side openings for cotter pin
138 fourth right holder(box)
139 side openings for cotter pin
140 W shaped spring clip
142 first leg
143 through-hole in first leg
144 mid portion
146 second leg
147 through-hole in second leg
152 first cotter pin
154 second cotter pin
156 third cotter pin
200 Second Embodiment Rail Tie Plate with Vertical Supports for Horizontal Bars
202 first spike
204 second spike
210 rail tie plate
212 first elongated ridge
213 first spike hole
215 second spike hole
216 second elongated ridge
217 third spike hole
219 fourth spike hole
222 first left vertical bracket
223 upper through-hole
224 first right vertical bracket
225 upper through hole
232 second left vertical bracket
233 upper through-hole
234 second right vertical bracket
235 upper through-hole
240 first elongated rod
241 through-hole in one end
247 through-hole in opposite end
250 second elongated rod
251 through-hole in one end
257 through-hole in opposite end
260 cotter pin(s)
300 Third Embodiment Rail Tie Plate with Vertical Threaded Bar Ends & Nuts
302 first spike
304 second spike
310 rail tie plate
312 first elongated ridge
213 first spike hole
315 second spike hole
316 second elongated ridge
317 third spike hole
319 fourth spike hole
322 first left stud with threaded end
323 upper through-hole
324 first right stud with threaded end
325 upper through hole
332 second left stud with threaded end
333 upper through-hole
334 second right stud with threaded end
335 upper through-hole
240 first flat plate
341 through-hole in one end

347 through-hole in opposite end
250 second flat plate
351 through-hole in one end
257 through-hole in opposite end
360 cotter pin(s)
370 nuts & washers
400 Fourth Embodiment Tie Plate with Inverted L-shaped brackets
402 first spike
404 second spike
410 tie plate
412 first elongated ridge
413 first spike hole
415 second spike hole
416 second elongated ridge
417 third spike hole
419 fourth spike hole
422 first left stud with threaded end
424 first right stud with threaded end
432 second left stud with threaded end
434 second right stud with threaded end
440 first horizontal plate
441 through-hole adjacent one end
442 first plates inverted L shape bracket
444 second inverted L shape bracket
446 third inverted L shape bracket
448 fourth inverted L shape bracket
449 through-hole adjacent opposite end
450 second horizontal plate
451 through-hole adjacent one end
452 first plates inverted L shape bracket
454 second inverted L shape bracket
456 third inverted L shape bracket
458 fourth inverted L shape bracket
459 through-hole adjacent opposite end
470 nuts & washers
480 W shaped spring clip
482 first leg
483 groove/notch in first leg
484 mid portion
486 second leg
487 groove/notch in second leg
500 Fifth Embodiment Tie Plate of plurality of metal structures and with horizontal channels/openings
502 first spike
504 second spike
510 tie plate
512 first elongated ridge
513 first spike hole
515 second spike hole
516 second elongated ridge
517 third spike hole
519 fourth spike hole
540 plurality of left metal structures with horizontal channel openings
542 first left metal structure with horizontal channel opening
543 first left structure side through-hole
544 second left metal structure with horizontal channel opening
545 second left structure side through-hole
546 third left metal structure with horizontal channel opening
547 third left structure side through-hole
548 fourth left metal structure with horizontal channel opening
549 fourth left structure side through-hole
550 cotter pins
560 plurality of right metal structures with horizontal channel openings
562 first right metal structure with horizontal channel opening
563 first right structure side through-hole
564 second right metal structure with horizontal channel opening
565 second right structure side through-hole
566 third right metal structure with horizontal channel opening
567 third right structure side through-hole
568 fourth right metal structure with horizontal channel opening
569 fourth right structure side through-hole
570 cotter pins
580 w shaped spring clip
582 first leg
583 through-hole in first leg
584 mid portion
586 second leg
587 through-hole in second leg
600 SIXTH Embodiment Tie Plate of plurality of metal structures with angled channel openings
602 first spike
604 second spike
610 tie plate
612 first elongated ridge
613 first spike hole
615 second spike hole
616 second elongated ridge
617 third spike hole
619 fourth spike hole
640 plurality of left metal structures with angled channel openings
642 first left metal structure with angled channel
643 first left structure side through-hole
644 second left metal structure with angled channel
645 second left structure side through-hole
646 third left metal structure with angled channel
647 third left structure side through-hole
648 fourth left metal structure with angled channel
649 fourth left structure side through-hole
650 cotter pins
660 plurality of right metal structures with angled channel openings
662 first right metal structure with angled channel
663 first right structure side through-hole
664 second right metal structure with angled channel
665 second right structure side through-hole
666 third right metal structure with angled channel
667 third right structure side through-hole
668 fourth right metal structure with angled channel
669 fourth right structure side through-hole
670 cotter pins
680 w shaped spring clip
682 first leg
683 through-hole in first leg
684 mid portion
686 second leg
687 through-hole in second leg

First Embodiment

Figure 3:
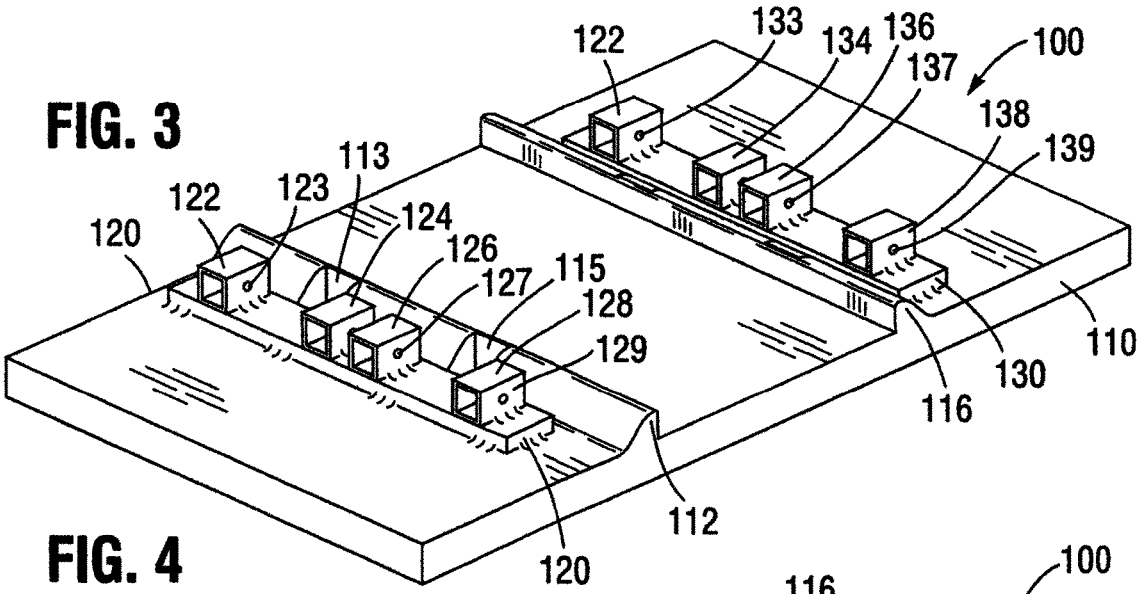
FIG. 3 is an upper perspective view of a spring clip tie plate embodiment.

FIG. 3 is an upper perspective view of a spring clip tie plate 100

Figure 4:
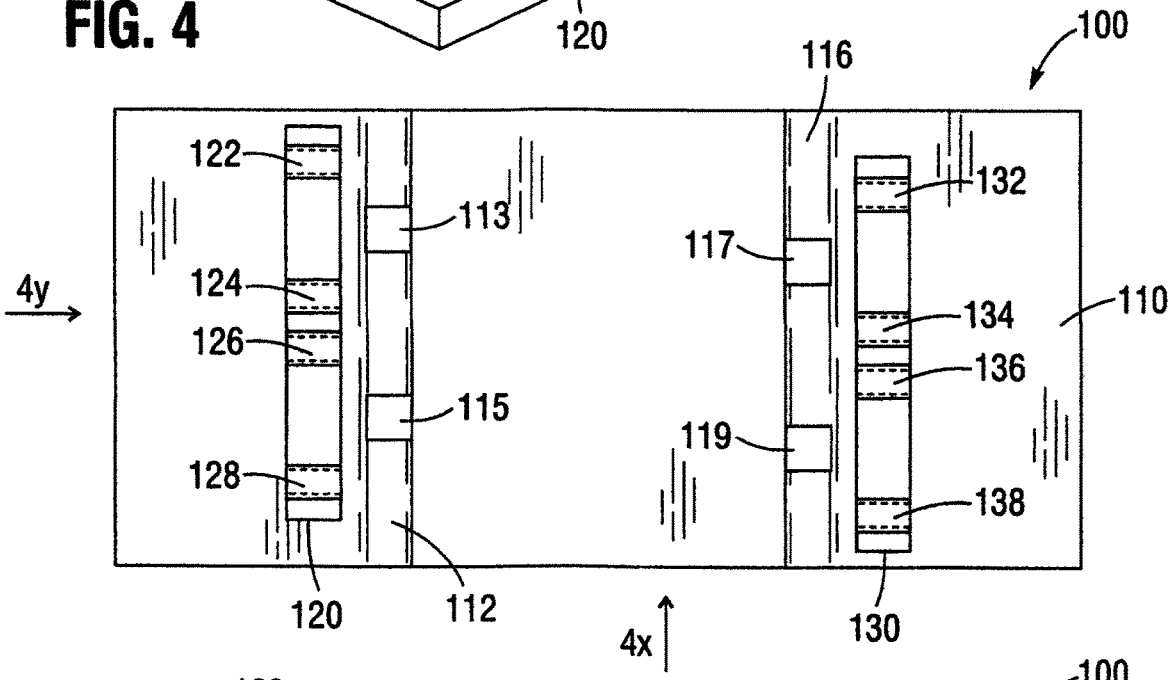
FIG. 4 is a top view of the spring clip tie plate of FIG. 3.
Figure 5:
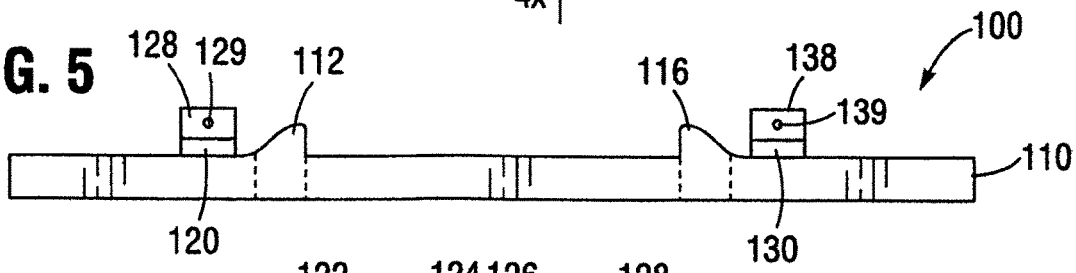
FIG. 5 is a side view of the spring clip tie plate of FIG. 4 along arrow 4X.

FIG. 4 is a top view of the spring clip tie plate 100 of FIG. 3. FIG. 5 is a side view of the spring clip tie plate 100 of FIG.

Figure 6:
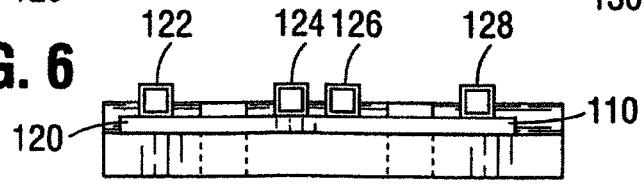
FIG. 6 is a front end view of the spring clip tie plate of FIG. 4 along arrow 4Y.

4 along arrow 4X. FIG. 6 is a front end view of the spring clip tie plate 100 of FIG. 4 along arrow 4Y.

Referring to FIGS. 3-6, a tie plate 110 similar to those shown and described in the prior art of FIGS. 1A and 1B and can be modified.

The new railroad tie plate embodiment 100 can be manufactured in a factory and replaces the old railroad tie plate. This happens when the railroad ties need replacing or when service work needs to be done. It also happens when new rail track is laid down.

A first plurality of holders that can have box shapes 122, 124, 16, 128 can be fixed to an upper surface of a left rectangular base plate 120 by being welded, and the like. Each of the first plurality of holders can have side through-holes 123, 125, 127, 129 running from one side of each box shape through to another side of each box shape. The outer facing sides of each of the plurality of holders 122, 124, 126, 128 can be open. The left base plate 120 with first plurality of holders 122, 124, 126, 128 can be attached to an upper surface of the tie plate 110 adjacent to an outer side of the first raised ridge 112 by being welded, and the like.

A second plurality of holders that can have box shapes 132, 134, 136, 138 can be fixed to an upper surface of a right rectangular base plate 120 by being welded, and the like. Each of the second plurality of holders can have side through-holes 133, 135, 137, 139 running from one side of each box shape through to another side of each box shape. The outer facing sides of each of the plurality of holders 132, 134, 136, 138 can be open. The right base plate 130 with second plurality of holders 132, 134, 136, 138 can be attached to an upper surface of the tie plate 110 adjacent to an outer side of the second raised ridge 114 by being welded, and the like.

The tie plate 110 can include a first spike hole 113, and second spike hole 115 running from a top side of the tie plate 110 through the elongated ridge 112, through the bottom side of the tie plate 110. The tie plate 110 can include a third spike hole 117, and fourth spike hole 119 running from a top side of the tie plate 110 through the other elongated ridge 116, through the bottom side of the tie plate 110.

Figure 7A:
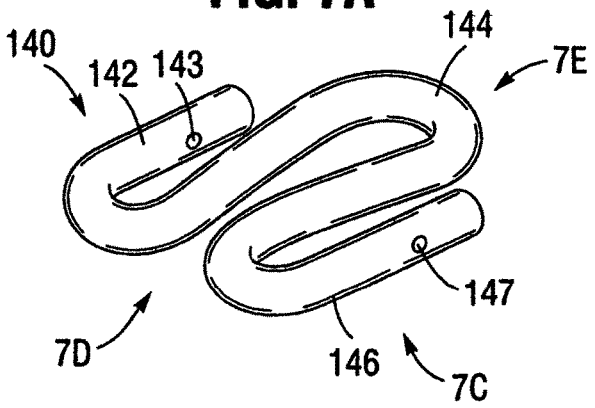
FIG. 7A is an upper perspective view of a w spring clip.
Figure 7B:
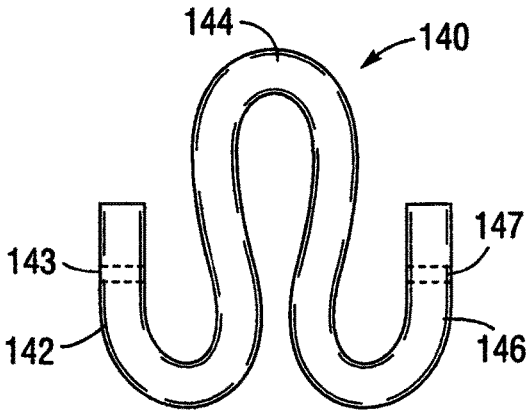
FIG. 7B is a top view of the w spring clip of FIG. 7A.
Figure 7C:
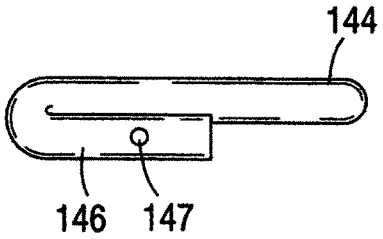
FIG. 7C is a side view of the w spring clip of FIG. 7A along arrow 7C.
Figure 7D:
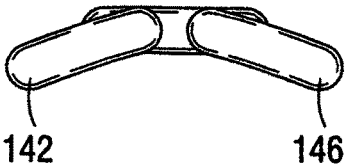
FIG. 7D is a front view of the w spring clip of FIG. 7A along arrow 7D.
Figure 7E:
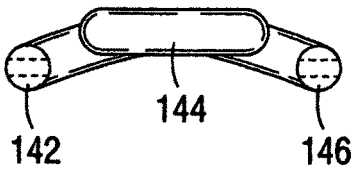
FIG. 7E is a rear view of the w spring clip of FIG. 7A along arrow 7E.

FIG. 7A is an upper perspective view of a W spring clip 140. FIG. 7B is a top view of the W spring clip 140 of FIG. 7A. FIG. 7C is a side view of the W spring clip 140 of FIG. 7A along arrow 7C. FIG. 7D is a front view of the W spring clip 140 of FIG. 7A along arrow 7D. FIG. 7E is a rear view of the W spring clip 140 of FIG. 7A along arrow 7E.

Each W spring clip 140 can be made from steel, spring steel and the like, with a first leg 142, through-hole 143 running from one side of the first leg 142 to welded, and the other side, curved (bent) midportion 144, a second leg 146 and a through-hole 147 running from one side of the second leg 146 to the other side.

A process for using invention will now be described. A machine on the tracks pulls existing spikes out on a section of track. Then a machine, such as a crane, lifts the tracks high enough to remove the existing railroad tie plates. Then the wooden tie is pulled out from underneath the rails. Then new ties are inserted under the rails as they are still lifted up. Once the wooden ties are in place the new railroad tie plates 100 are slid under the rail which is then lowered on to the plates 110. Each rail 20 sits between two bumps (elongated parallel ridges 112, 116, which form a pocket for the rail 20.

Referring to FIGS. 1-6 and 8, the spikes 6, 8 are then driven into the spike holes 113, 115, and another pair of spikes (not shown) driven into the spike holes 117, 119.

Figure 8A:
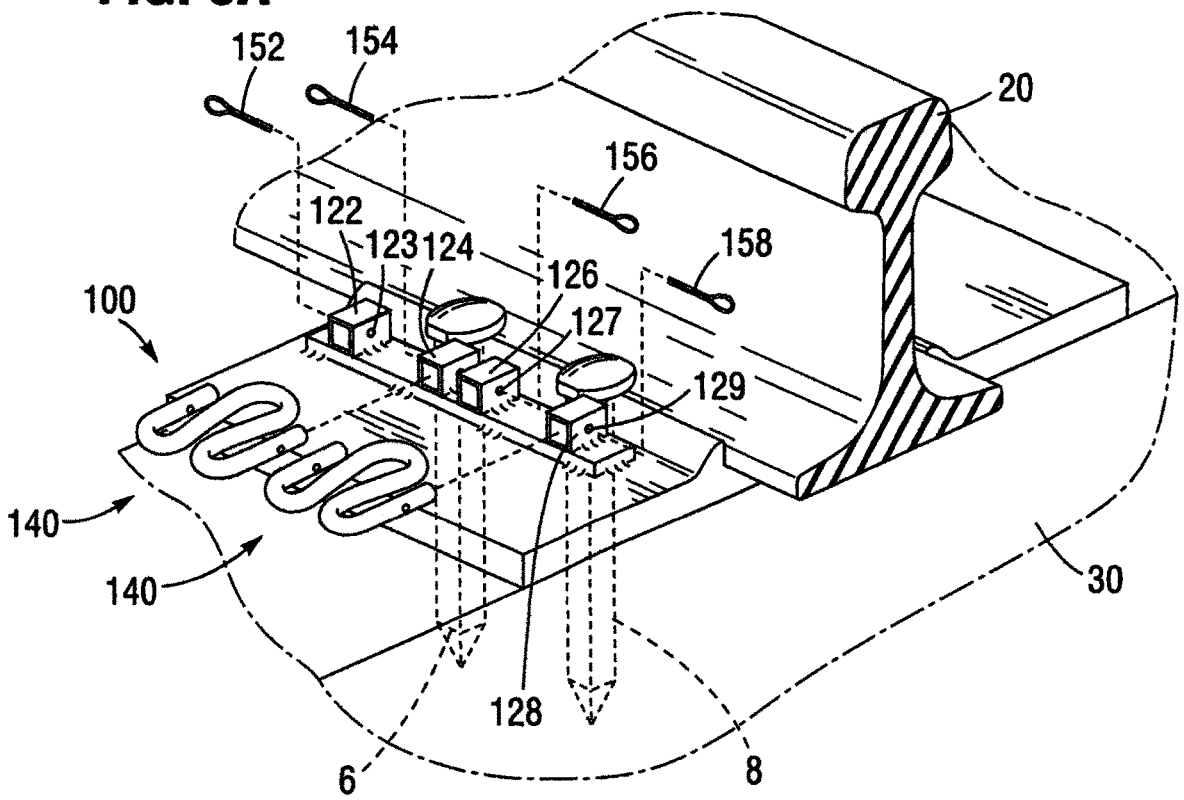
FIG. 8A is an upper perspective view of the spring clip tie plate of FIGS. 3-6 mounted between a rail and a tie, with the w spring clip(s) of FIGS. 7A-7C about to be attached.

FIG. 8A is an upper perspective view of the spring clip tie plate 100 of FIGS. 3-6 mounted between a rail 20 and a tie 30, with the W spring clip(s) 140 of FIGS. 7A-7C about to be attached.

Figure 8B:
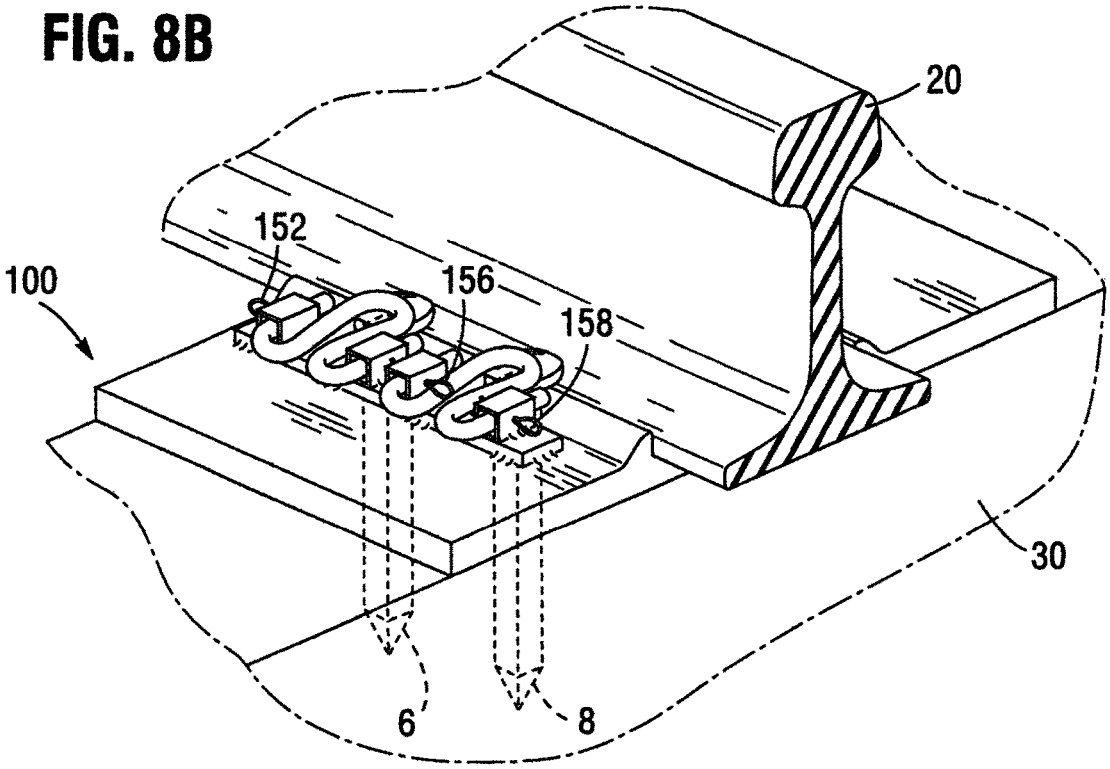
FIG. 8B is an upper perspective view of FIG. 8A with the w spring clip(s) assembled with the spring clip tie plate.

FIG. 8B is an upper perspective view of FIG. 8A with the W spring clip(s) 140 assembled with the spring clip tie plate embodiment 100.

Referring to FIGS. 7A-7E and 8A-8B, the free ends 142, 146 of the w clips 140 by the W clips are pushed into the apertures outer side openings in the plurality of holders 122, 124, 126, 128, 132, 134, 135, 138 and the bent midportion 144 of the W spring clips 140 are pushed and over the top of the spike heads on the spikes 6, 8.

Referring to FIGS. 3, 8A and 8B, to lock the W clips 140 in place, cotter pins 152, 154, 156, 158 are then pushed into the holes securing and locking the legs 142*m* 146 of the w clips 140 to the tie plate 110.

The other side of the rail 20 is similarly attached to the rail tie with another set of w clips 140 in a similar manner.

Second Embodiment

The new railroad tie plate embodiment 200 can be manufactured in a factory and replaces the old railroad tie plate. This happens when the railroad ties need replacing or when service work needs to be done. It also happens when new rail track is laid down.

A process for using invention will now be described which is similar to the process for installing the first embodiment above. A machine on the tracks pulls existing spikes out on a section of track. Then a machine, such as a crane, lifts the tracks high enough to remove the existing railroad tie plates. Then the wooden tie is pulled out from underneath the rails. Then new ties are inserted under the rails as they are still lifted up. Once the wooden ties are in place the new railroad tie plates 210 (shown in FIGS. 9-12) are slid under the rail which is then lowered on to the plates 210.

Each rail 20 sits between two bumps (elongated parallel elongated ridges 212, 216 on the rail tie plate 210 which form a pocket for the rail 20.

Figure 13A:
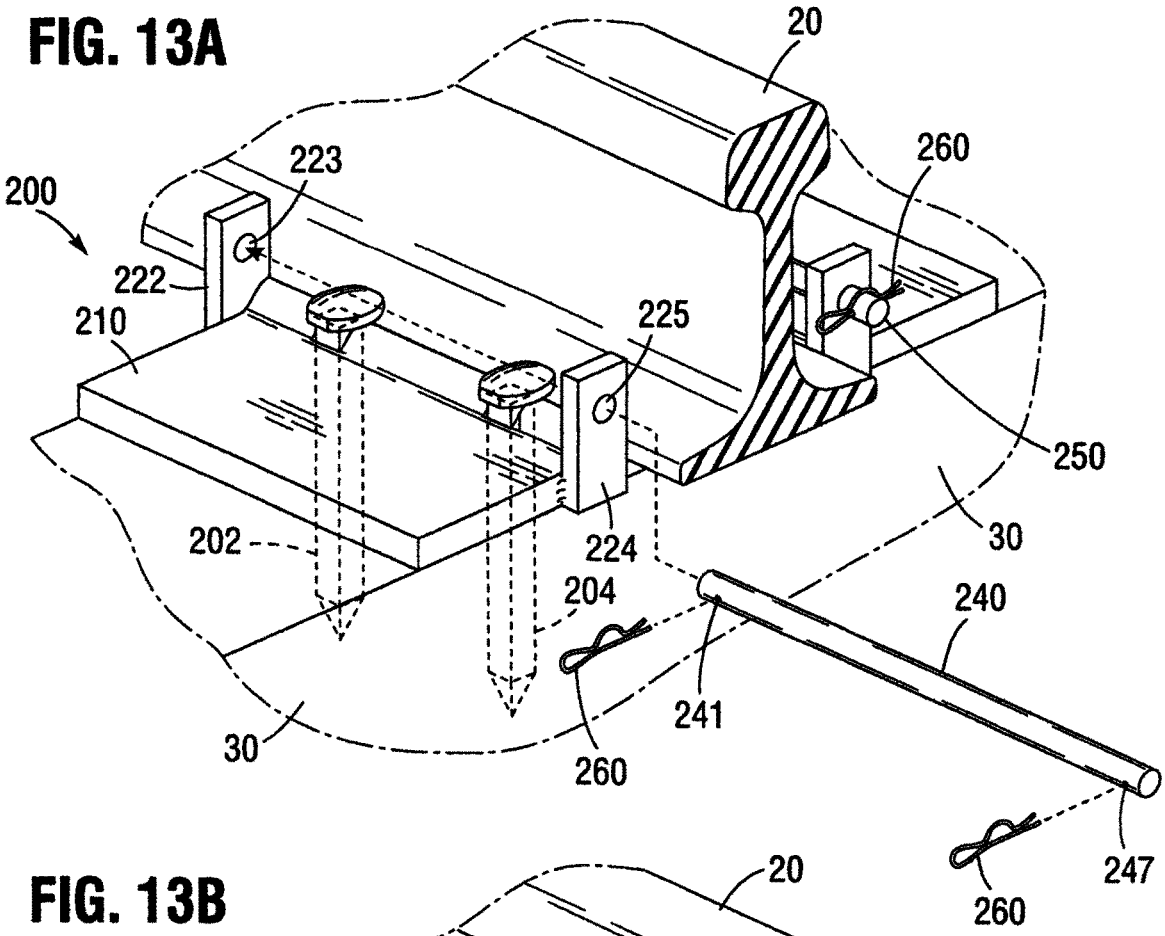
FIG. 13A is an upper perspective view of the tie plate with vertical steel brackets of FIGS. 10-12 mounted between a rail and tie with a steel rod ready to be inserted through holes in the vertical brackets/
Figure 13B:
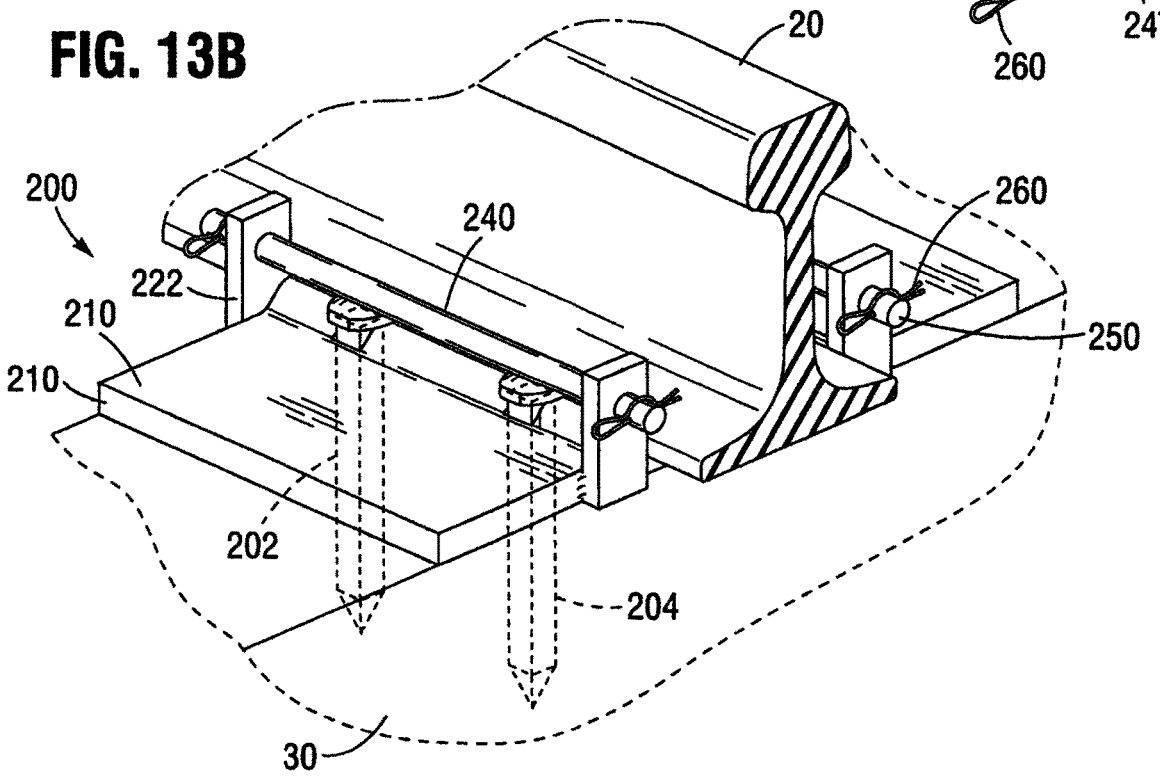
FIG. 13B is an upper perspective view of FIG. 13A with the steel rod mounted through the holes in the vertical brackets over the top of the spikes and locked in place with cotter pins.

Spikes 202, 204 (shown in FIGS. 13A-13B are then driven into spike holes 213, 215 in the tie plate 210 and another pair of spikes (not shown) driven into another set of spike holes 217, 219.

Figure 9:
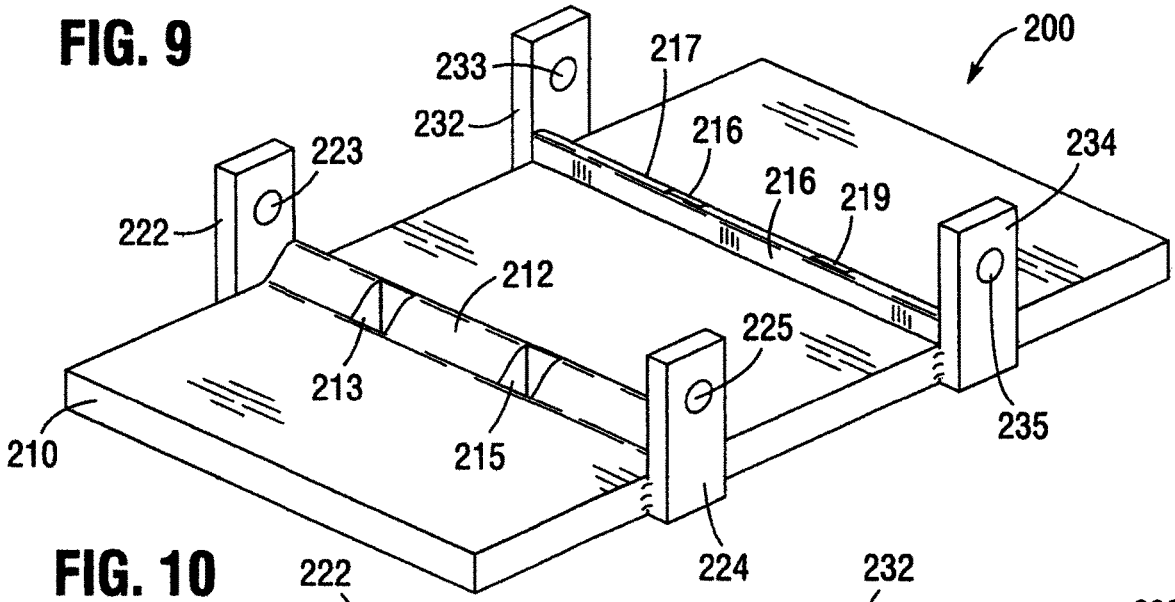
FIG. 9 is an upper perspective view of a second embodiment of a tie plate with vertical steel brackets for supporting steel rods to retain railroad spikes.
Figure 10:
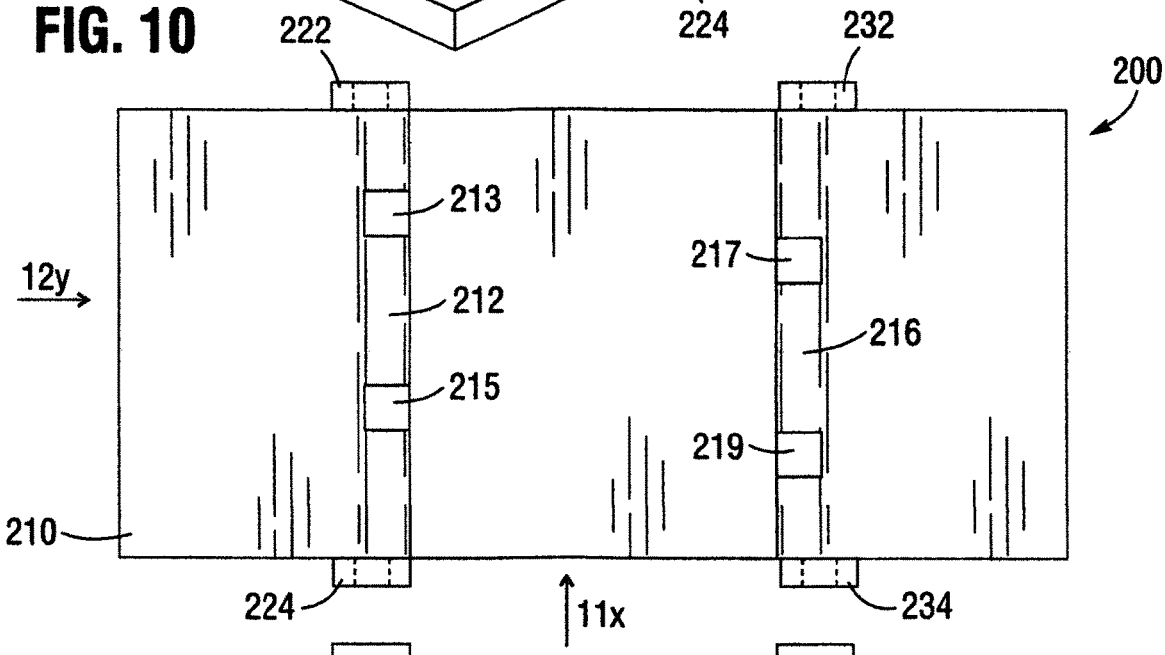
FIG. 10 is a top view of the tie plate with vertical steel brackets of FIG. 9.

FIG. 9 is an upper perspective view of a second embodiment 200 of a tie plate 210 with vertical steel brackets 222, 224, 322, 324 for supporting steel rods to retain railroad spikes. FIG. 10 is a top view of the tie plate 210 with vertical steel brackets 222, 224, 322, 324 of FIG. 9.

Figure 11:
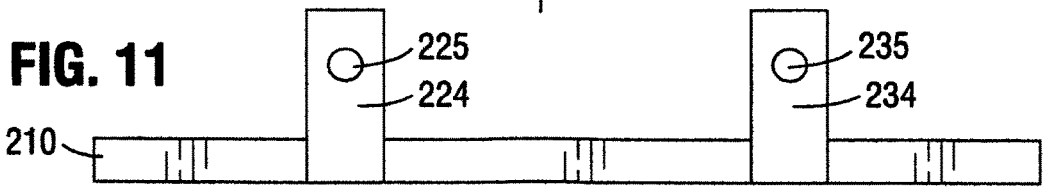
FIG. 11 is a side view of the tie plate with vertical steel brackets of FIG. 10 along arrow 11X.
Figure 12:
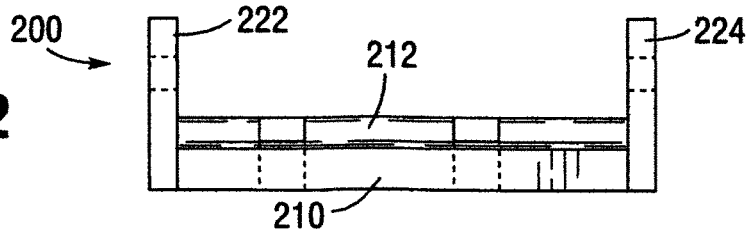
FIG. 12 is a front end view of the tie plate with vertical steel brackets of FIG. 10 along arrow 12Y.

FIG. 11 is a side view of the tie plate 210 with vertical steel brackets 222, 224, 322, 324 of FIG. 10 along arrow 11X. FIG. 12 is a front end view of the tie plate 210 with vertical steel brackets 222, 224, 322, 324 of FIG. 10 along arrow 12Y.

Referring to FIGS. 9-12, a rail tie plate 210 can have a first spike hole 213, and second spike hole 215 running from a top side of the tie plate 210 through the elongated ridge 212, through the bottom side of the tie plate 210. The tie plate 210 can include a third spike hole 217, and fourth spike hole 219 running from a top side of the tie plate 210 through the second elongated ridge 216, through the bottom side of the tie plate 210.

A first left bracket 222 can be welded to the outer side of the tie plate 210 along the left side of the first elongated ridge 212, and a first right bracket 224 can be welded to an opposite outer side of the tie plate 210 along the right side of the first elongated ridge 212.

A second left bracket 232 can be welded to the outer side of the tie plate 210 along the left side of the second elongated ridge 216, and a second right bracket 224 can be welded to an opposite outer side of the tie plate 210 along the right side of the second elongated ridge 216.

The vertical brackets 222, 224, 232, 234 can each have upper through-holes 223, 235, 233, 235 passing from one side of each bracket to an opposite side.

FIG. 13A is an upper perspective view of the tie plate 210 with vertical steel brackets 222, 224, 232, 234 of FIGS. 10-12 mounted between a rail 20 and tie 30 with a steel rod 240 ready to be inserted through holes in the vertical brackets 222, 224. One end or steel rod 240 with through-hole 241 is inserted into through-hole 225 of second vertical bracket 224 and then through through-hole 223 of first elongated bracket 222.

FIG. 13B is an upper perspective view of FIG. 13A with the steel rod mounted 240 through the holes 223, 225 in the first vertical brackets 222, 224 over the top of the spikes 202, 204 and locked in place with cotter pins 260 inserted into through-holes 241, 247 in the ends of first elongated rod 240. As shown in FIG. 13B, a second elongated rod 250 having ends with through holes 251, 257 can be similarly mounted in second left vertical bracket 232, and second right vertical bracket 234 and locked in place with additional cotter pins 260 to be used to retain another set of spikes (not shown) in place.

Third Embodiment

The new railroad tie plate embodiment 300 can be manufactured in a factory and replaces the old railroad tie plate. This happens when the railroad ties need replacing or when service work needs to be done. It also happens when new rail track is laid down.

A process for using invention will now be described which is similar to the process for installing the first and second embodiment above. A machine on the tracks pulls existing spikes out on a section of track. Then a machine, such as a crane, lifts the tracks high enough to remove the existing railroad tie plates. Then the wooden tie is pulled out from underneath the rails. Then new ties are inserted under the rails as they are still lifted up. Once the wooden ties are in place the new railroad tie plates 310 (shown in FIGS. 9-12) are slid under the rail which is then lowered on to the plates 310.

Each rail 20 sits between two bumps (elongated parallel elongated ridges 312, 316 on the rail tie plate 310 which form a pocket for the rail 20.

Figure 18A:
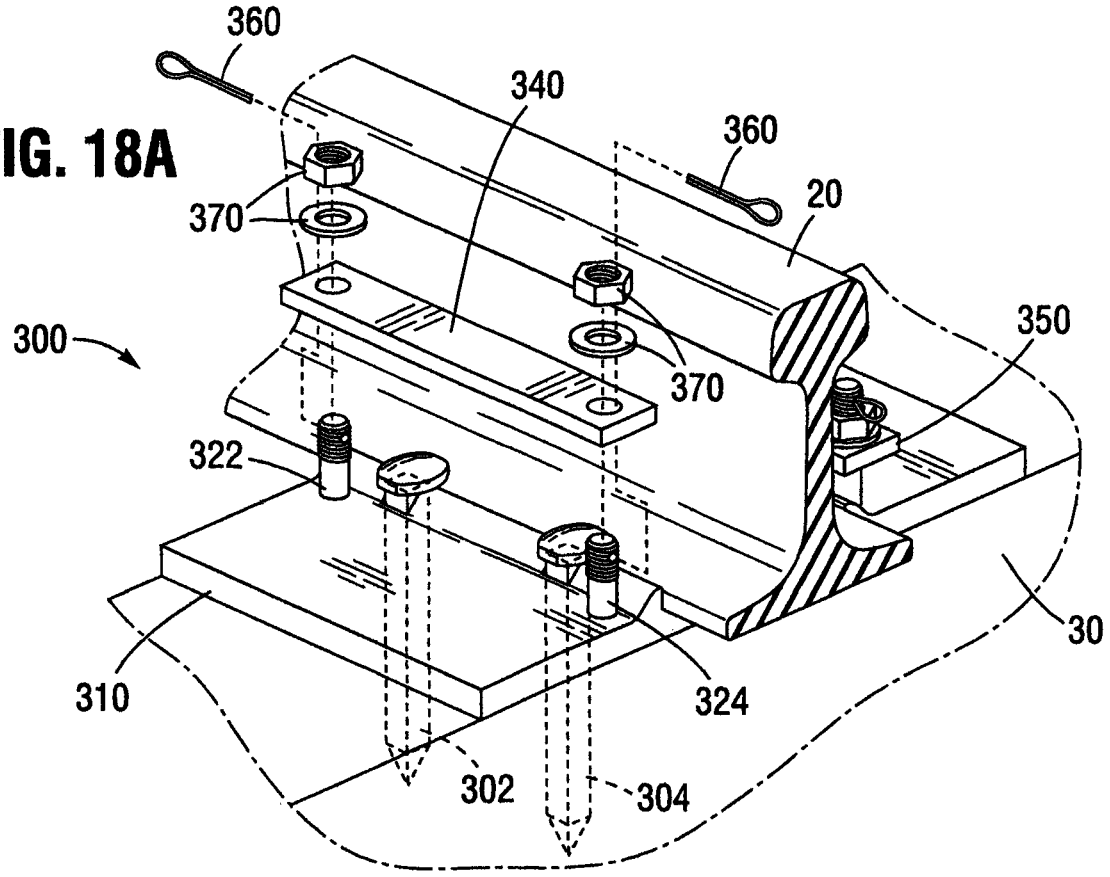
FIG. 18A is an upper perspective view of the tie plate of FIGS. 14-17 mounted between a rail and tie with a flat plate about to be attached to the upwardly facing threaded end vertical studs and nuts and washers used on the threaded ends with cotter pins.
Figure 18B:
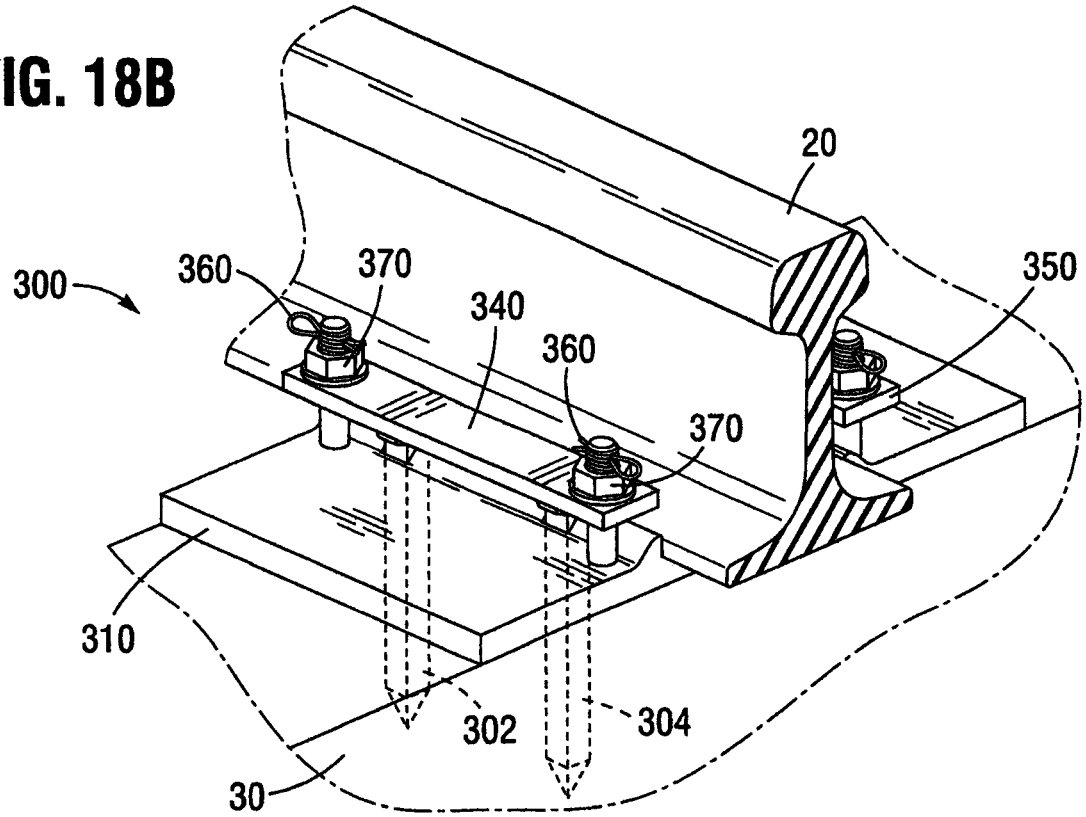
FIG. 18B is an upper perspective view of FIG. 18A with the flat plate attached to the threaded ends of the vertical studs with nuts washers over the top of the spikes and locked in place with cotter pins.

Spikes 302, 304 (shown in FIGS. 18A-18B are then driven into spike holes 313, 315 in the tie plate 210 and another pair of spikes (not shown) driven into another set of spike holes 317, 319.

Figure 14:
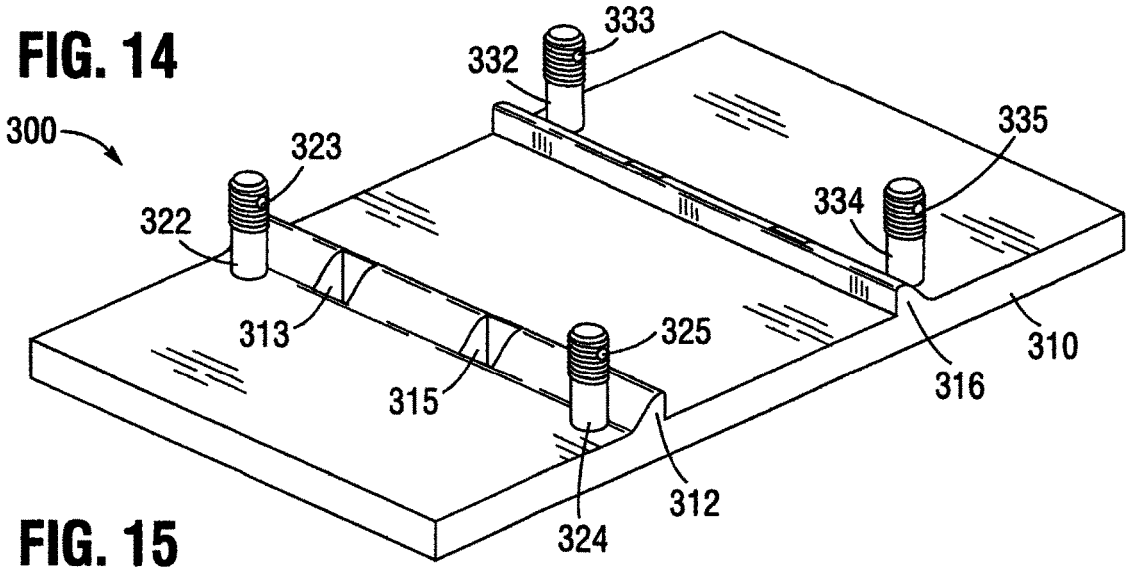
FIG. 14 is an upper perspective view of a third embodiment of a tie plate with upwardly facing vertical studs having threaded ends for flat plates to be attached to retain railroad spikes.

FIG. 14 is an upper perspective view of a third embodiment 300 of a tie plate with upwardly facing vertical studs 322, 324, 332, 334 having threaded ends for flat plates 340, 350 to be attached to retain railroad spikes.

Figure 15:
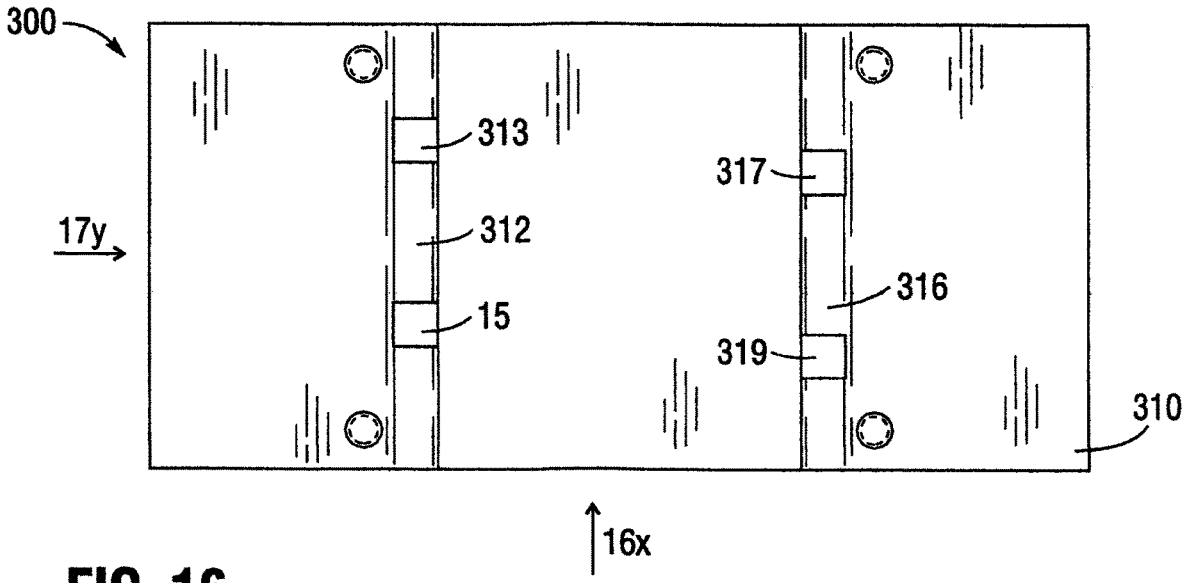
FIG. 15 is a top view of the tie plate with upwardly facing threaded end vertical studs of FIG. 14.
Figure 16:
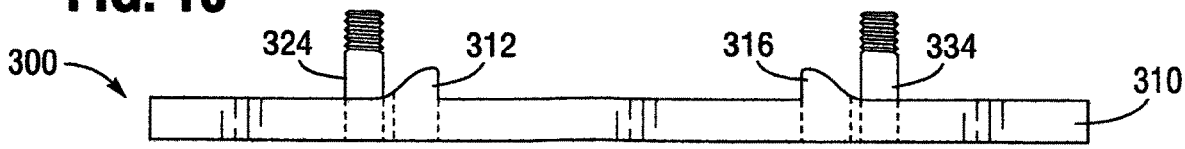
FIG. 16 is a side view of the tie plate with upwardly facing threaded end vertical studs of FIG. 15 along arrow 16X.
Figure 17:
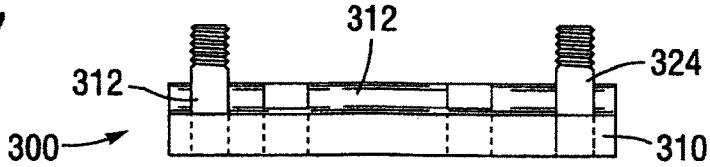
FIG. 17 is a front end view of the tie plate with upwardly facing threaded end vertical studs of FIG. 15 along arrow 17Y.

FIG. 15 is a top view of the tie plate 310 with upwardly facing threaded end vertical studs 322, 324, 332, 334 of FIG. 14. FIG. 16 is a side view of the tie plate 310 with upwardly facing threaded end vertical studs 322, 324, 332, 334 of FIG. 15 along arrow 16X. FIG. 17 is a front end view of the tie plate 310 with upwardly facing threaded end vertical studs 322, 324, 332, 334 of FIG. 15 along arrow 17Y.

Referring to FIGS. 14-17, a rail tie plate 310 can have a first spike hole 313, and second spike hole 315 running from a top side of the tie plate 310 through the first elongated ridge 312, through the bottom side of the tie plate 310. The tie plate 310 can include a third spike hole 317, and fourth spike hole 319 running from a top side of the tie plate 310 through the second elongated ridge 316, through the bottom side of the tie plate 310.

A first left stud with threaded end 322 can be welded through the tie plate 310 along a left side of the first elongated ridge 312, and a first right stud with threaded end 324 can be welded through the tie plate 310 along the right side of the first elongated ridge 312.

A second left stud with threaded end 332 can be welded through the tie plate 310 along the left side of the second elongated ridge 316, and a second right stud with threaded end 334 can be welded through the tie plate 310 along the right side of the second elongated ridge 316.

The vertical oriented studs with threaded ends 322, 324, 332, 334 can each have upper through-holes 323, 325, 333, 335 passing from one side of each threaded ends to an opposite side.

FIG. 18A is an upper perspective view of the tie plate 310 of FIGS. 14-17 mounted between a rail 20 and tie 30 with a flat plate about to be attached to the studs and nuts used on the threaded ends with cotter pins.

FIG. 18B is an upper perspective view of FIG. 18A with the flat plate attached to the threaded ends of the vertical studs with nuts and washers over the top of the spikes 302, 304 and locked in place with cotter pins 360.

As shown in FIG. 18B, a second flat plate 350 having ends with through holes 351, 357 can be similarly mounted in second left vertical stud with threaded end 332, and second right vertical stud with threaded end 334 and locked in place with nuts & washers 370 and additional cotter pins 360 to be used to retain another set of spikes (not shown) in place.

Fourth Embodiment

Figure 19A:
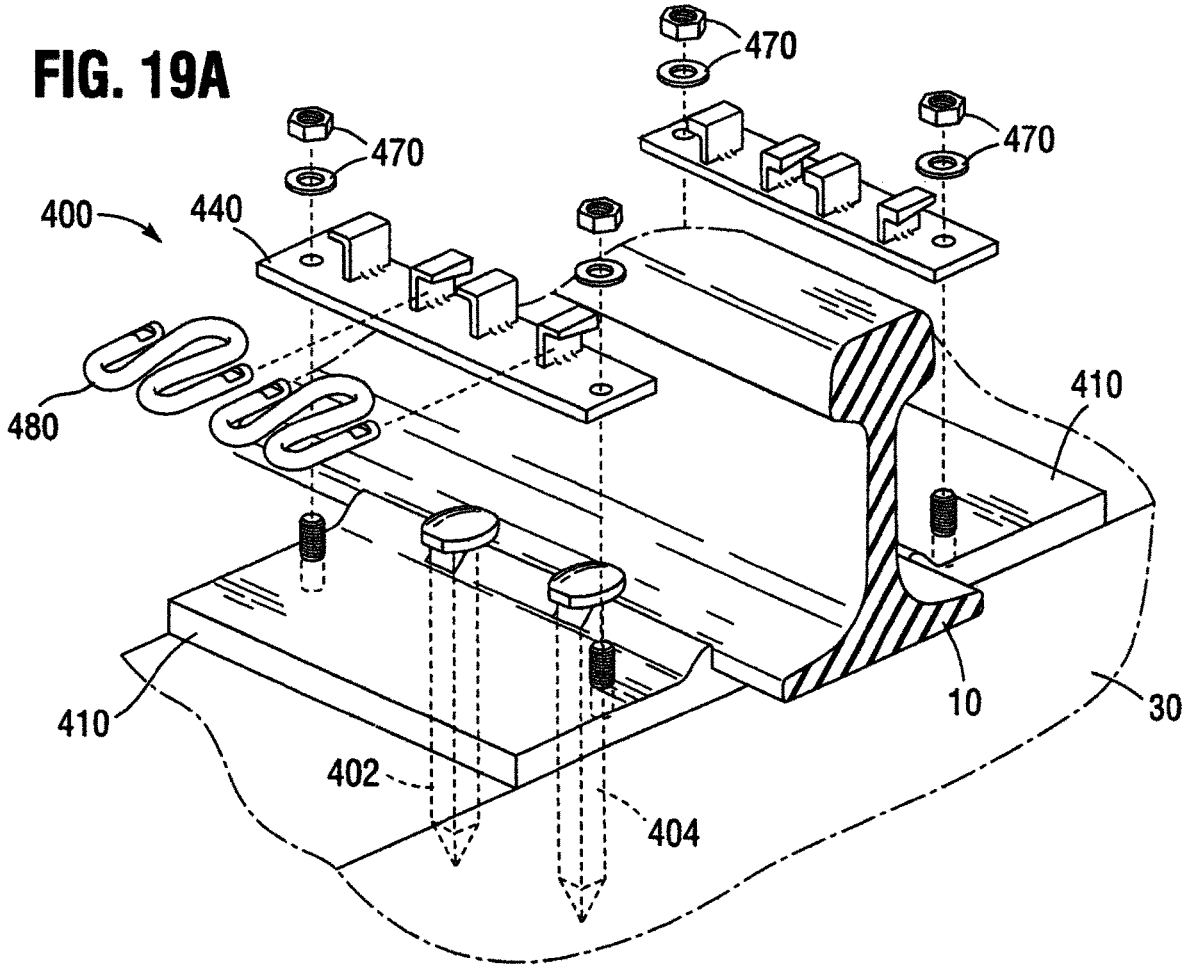
FIG. 19A is an upper perspective view of another unassembled spring clip tie plate with w spring clip(s) about to be attached in a fourth embodiment.
Figure 19B:
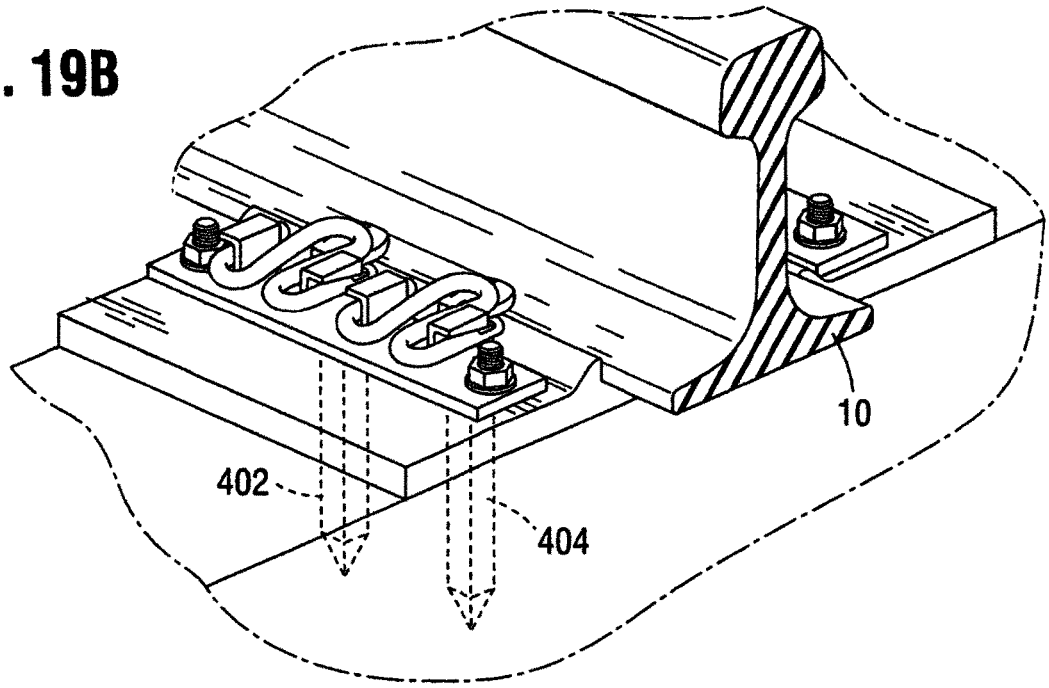
FIG. 19B is an upper perspective view of FIG. 19A with the w spring clip(s) assembled with the spring clip tie plate retaining the spikes.

FIG. 19A is an upper perspective view of another unassembled spring clip tie plate 410 with w spring clip(s) 480 about to be attached in a fourth embodiment 400 FIG. 19B is an upper perspective view of FIG. 19A with the w spring clip(s) 480 assembled with the spring clip tie plate 410 retaining the spikes 402, 404.

Figure 20:
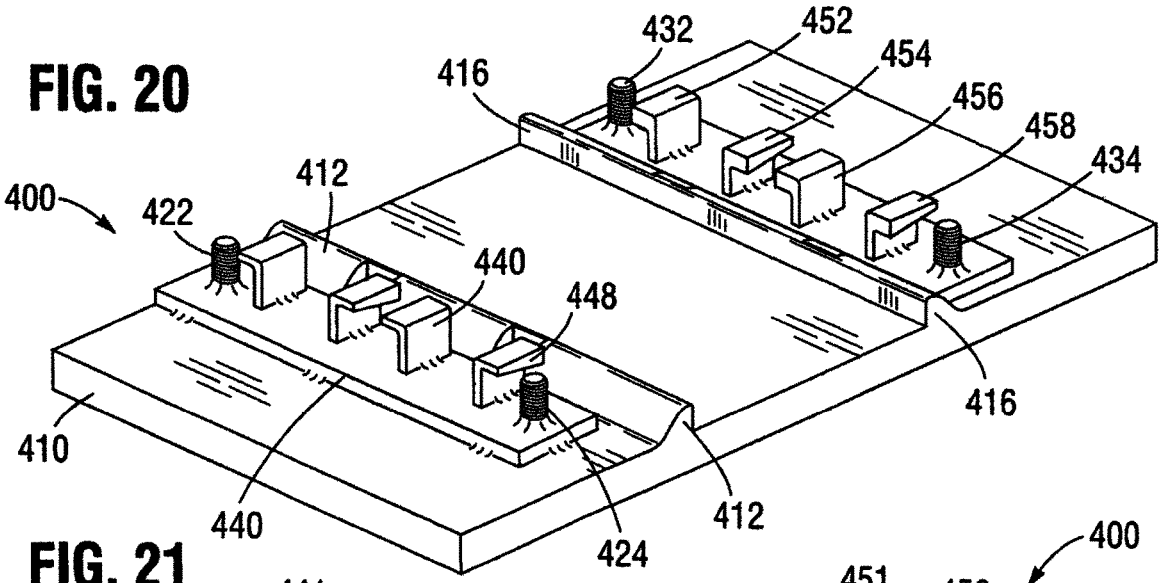
FIG. 20 is an upper perspective view of a fourth embodiment of the assembled spring clip tie plate of FIG. 19B.
Figure 21:
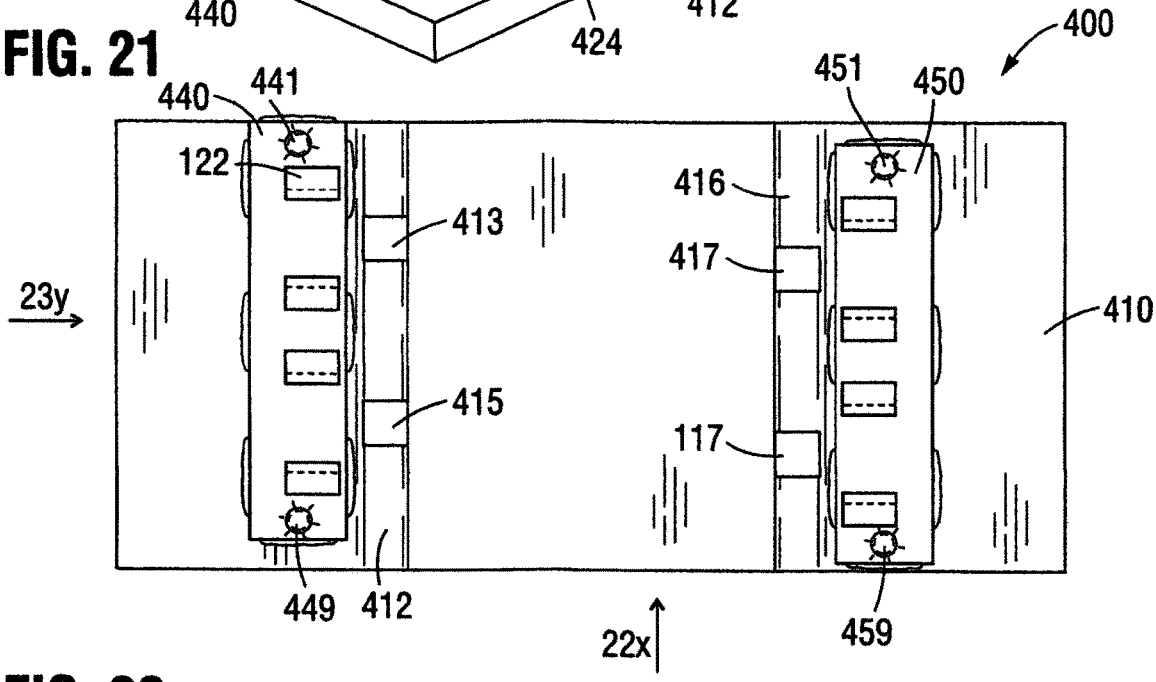
FIG. 21 is a top view of the assembled spring clip tie plate of FIG. 20.
Figure 22:
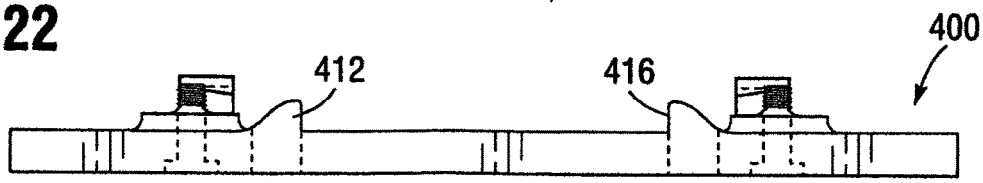
FIG. 22 is a side view of the assembled spring clip tie plate of FIG. 21 along arrow 22X.
Figure 23:
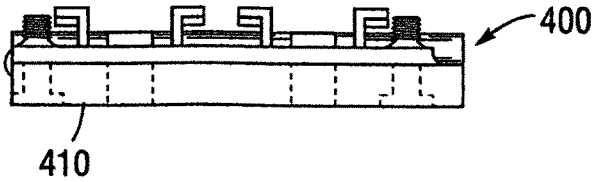
FIG. 23 is a front end view of the assembled spring clip tie plate of FIG. 21 along arrow 23Y.

FIG. 20 is an upper perspective view of a fourth embodiment 400 of the assembled spring clip tie plate 410 of FIG. 19B. FIG. 21 is a top view of the assembled spring clip tie plate 410 of FIG. 20. FIG. 22 is a side view of the assembled spring clip tie plate 410 of FIG. 21 along arrow 22X. FIG. 23 is a front end view of the assembled spring clip tie plate 410 of FIG. 21 along arrow 23Y.

Figure 24A:
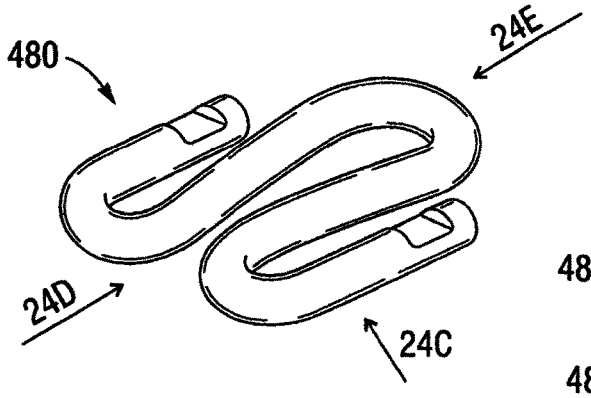
FIG. 24A is an upper perspective view of a w spring clip used in FIGS. 19A-19B.
Figure 24B:
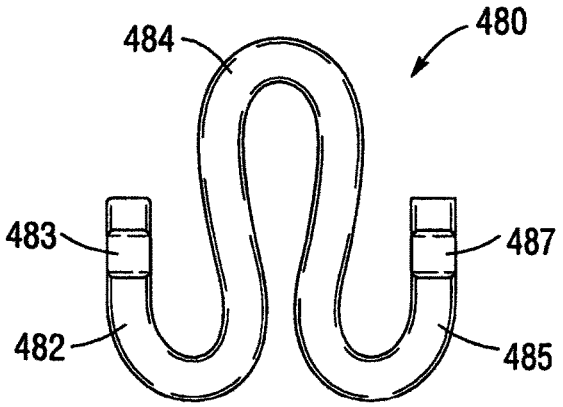
FIG. 24B is a top view of the w spring clip of FIG. 24A.
Figure 24C:
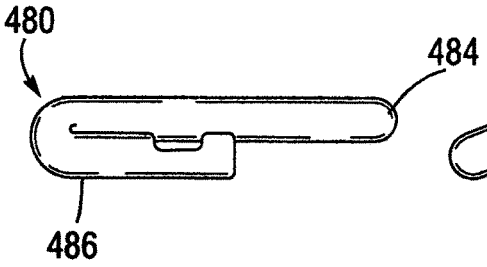
FIG. 24C is a side view of the w spring clip of FIG. 24A along arrow 24C.
Figure 24D:
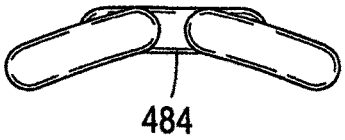
FIG. 24D is a front view of the w spring clip of FIG. 24A along arrow 24D.
Figure 24E:
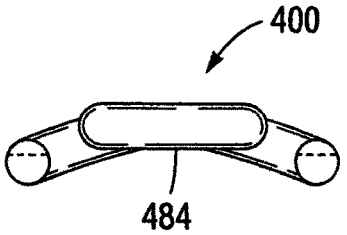
FIG. 24E is a rear view of the w spring clip of FIG. 24A along arrow 24E.

FIG. 24A is an upper perspective view of a w spring clip 480 used in FIGS. 19A-19B. FIG. 24B is a top view of the w spring clip 480 of FIG. 24A. FIG. 24C is a side view of the w spring clip of FIG. 24A along arrow 24C. FIG. 24D is a front view of the w spring clip 480 of FIG. 24A along arrow 24D. FIG. 24E is a rear view of the w spring clip 480 of FIG. 24A along arrow 24E.

The w spring clip 480 can be similar to the spring clip used and described in U.S. Pat. No. 5,520,330 to Brown et al., which is incorporated by reference in its' entirety.

Referring to FIGS. 24A-24E, the w spring clip 480 can include a first leg 482 with groove/notch 483, and a bent midportion 484, and second leg 486 with groove/notch 487.

Referring to FIGS. 19A-24E, the fourth embodiment 400 can include a tie plate 410 having a first elongated ridge 412 parallel to a second elongated ridge 416 that is used to orient the rail 10 therebetween.

The tie plate 410 includes a first set of spike holes 413, 415 for allowing spikes 402, 404 to pass through adjacent to the first raised ridge 412 and a second set of spike holes spikes 417, 419 adjacent a second raised ridge 416 for allowing a second set of spikes (not shown) to pass through. The spikes are used to attach the tie plate to a railroad tie 30.

The tie plate 410 includes a first pair of upwardly extending studs 422, 424 with threaded ends fixed to the tie plate 410 adjacent to the first raised ridge 412, and a second pair of upwardly extending studs 432, 434 with threaded ends fixed to the tie plate 41—adjacent to the second raised ridge 416.

A first horizontal metal plate 440 can include upwardly facing first inverted L shaped brackets 442, 444, 446, 448, and through-holes 441, 449 for allowing the threaded ends of the first studs 422, 424 to pass therethrough, with fasteners 470 for attaching the first horizontal plate 440 to the threaded ends of the first studs 422, 424. The fasteners 470 can include nuts with or without washers.

The first inverted L shaped brackets, 442, 444, 446, 448 can be welded to an upper surface of the first horizontal plate 440 or forged thereon.

The tie plate 410 can include a second horizontal metal plate 450 with upwardly facing first inverted L shaped brackets 452, 454, 456, 458, and through-holes 451, 459 for allowing the threaded ends of a second set of studs 432, 434 to pass therethrough, with fasteners 470 for attaching the second horizontal plate 450 to the threaded ends of the second studs 432, 434. The fasteners 470 can include nuts with or without washers.

Similarly, the second inverted L shaped brackets, 452, 454, 456, 458 can be welded to an upper surface of the second horizontal plate 450 or forged thereon.

A pair of w shaped spring clips 480 can inserted into the first inverted L-shaped brackets 442, 444, 446, 448 with mid portions 484 of the w shaped spring clips 480 pushed over tops of the first set of spikes 402, 404 to retain the first set of spikes 402, 404 from coming out of the tie plate 410.

Similarly, another pair of pair of w shaped spring clips 480 can inserted into the second inverted L-shaped brackets 452, 454, 456, 458 with mid portions 484 of the w shaped spring clips 480 pushed over tops of another pair of spikes (not shown) to retain another pair of spikes from coming out of the tie plate 410.

Referring to FIGS. 19A-19B, 20 and 21, the horizontal plates 440, 450 can further be welded about perimeter edges to tie plate 410. Fasteners 470 can further be welded to the studs 422, 424, 432, 434.

Referring to FIGS. 19A, 19B, and 24B, the overhanging angled lip edges on inverted L-shaped brackets 442, 444, 446, 448, 452, 454, 456, 458 can fit into and engage with the grooves(notches) 483, 487 on legs 482, 486 of the spring clip(s) 480, locking the spring clip(s) 480 in place.

Figure 19C:
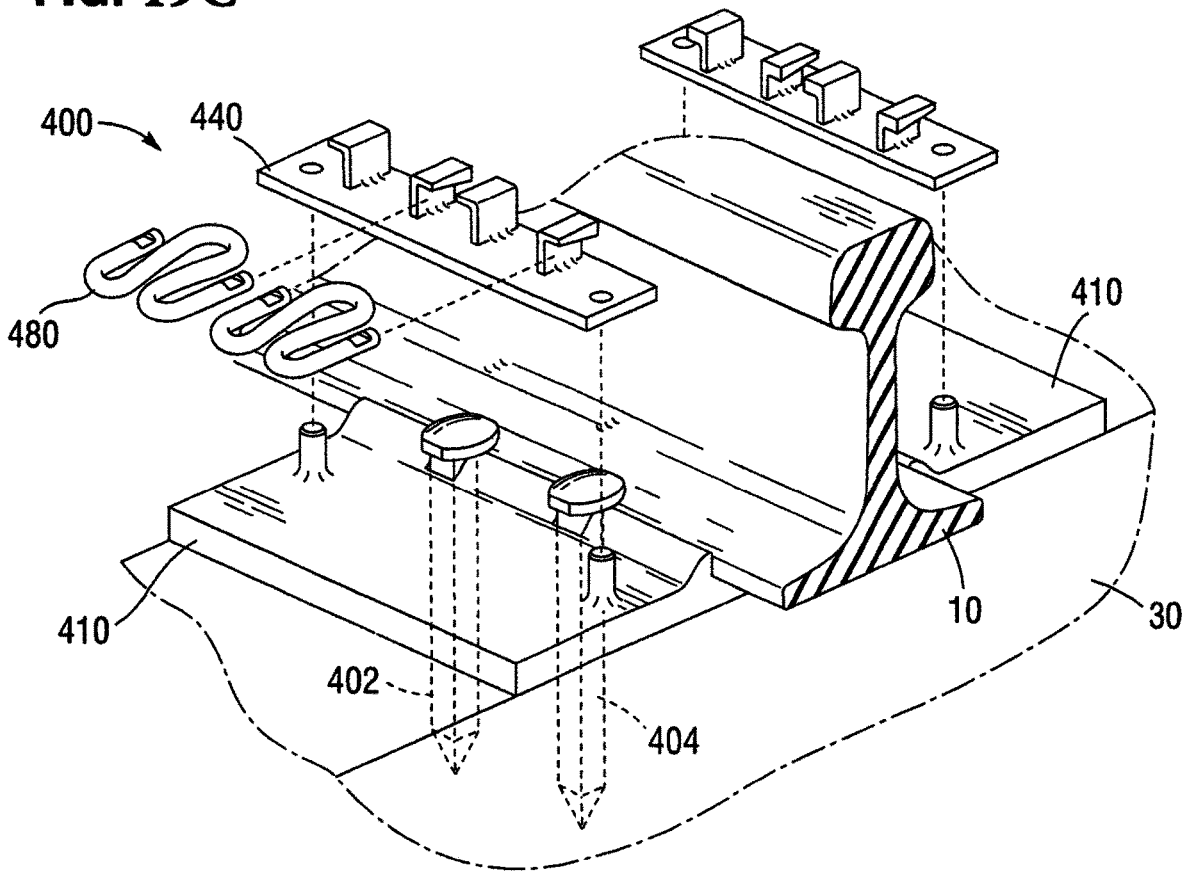
FIG. 19C is an upper perspective view of an alternative unassembled spring clip tie plate with w spring clip(s) about to be attached in a fourth embodiment in FIG. 19A.

FIG. 19C is an upper perspective view of an alternative unassembled spring clip tie plate with w spring clip(s) 480 about to be attached in a fourth embodiment in FIG. 19A.

Figure 19D:
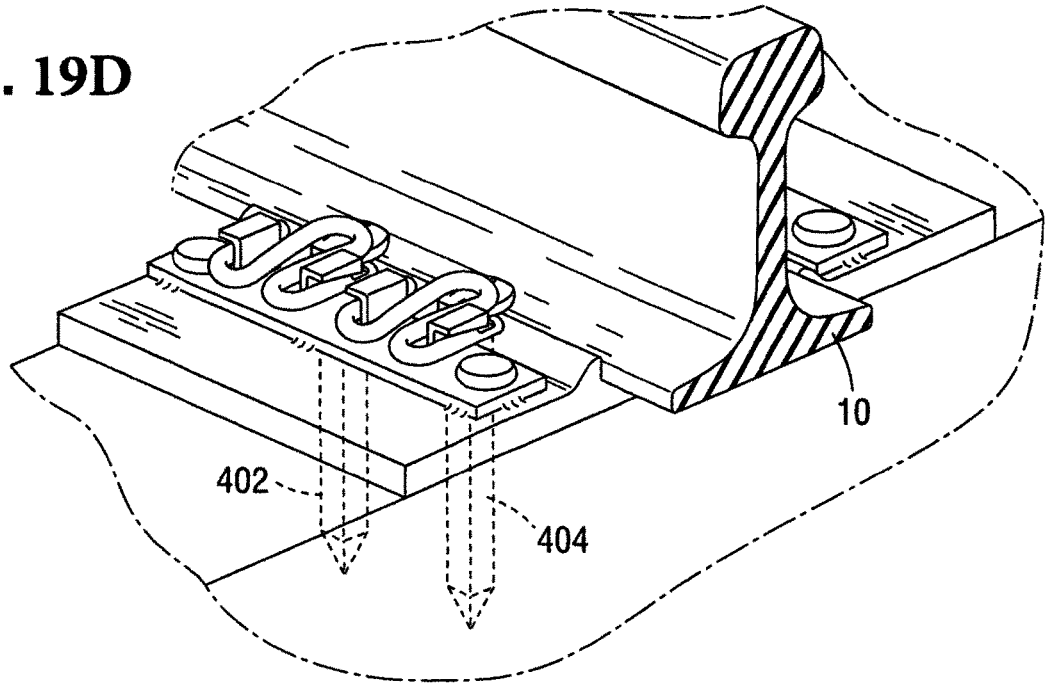
FIG. 19D is an upper perspective view of FIG. 19C with the w spring clip(s) assembled with the spring clip tie plate retaining the spikes.

FIG. 19D is an upper perspective view of FIG. 19C with the w spring clip(s) 480 assembled with the spring clip tie plate retaining the spikes.

Referring to FIGS. 19C-19D, upwardly protruding studs/rods 422, 424 without threaded ends can be used where the top of the studs/rods are heated and a hydraulic press, and the like, compresses the upper ends forming a head attaching a horizontal plate 440 to the tie plate 410. Alternatively, the upper ends of the studs 422, 424 can be welded or forged to the horizontal plate 440, and perimeter edges of horizontal plate 440 can be welded or forged to tie plate 410.

Fifth Embodiment

Figure 25A:
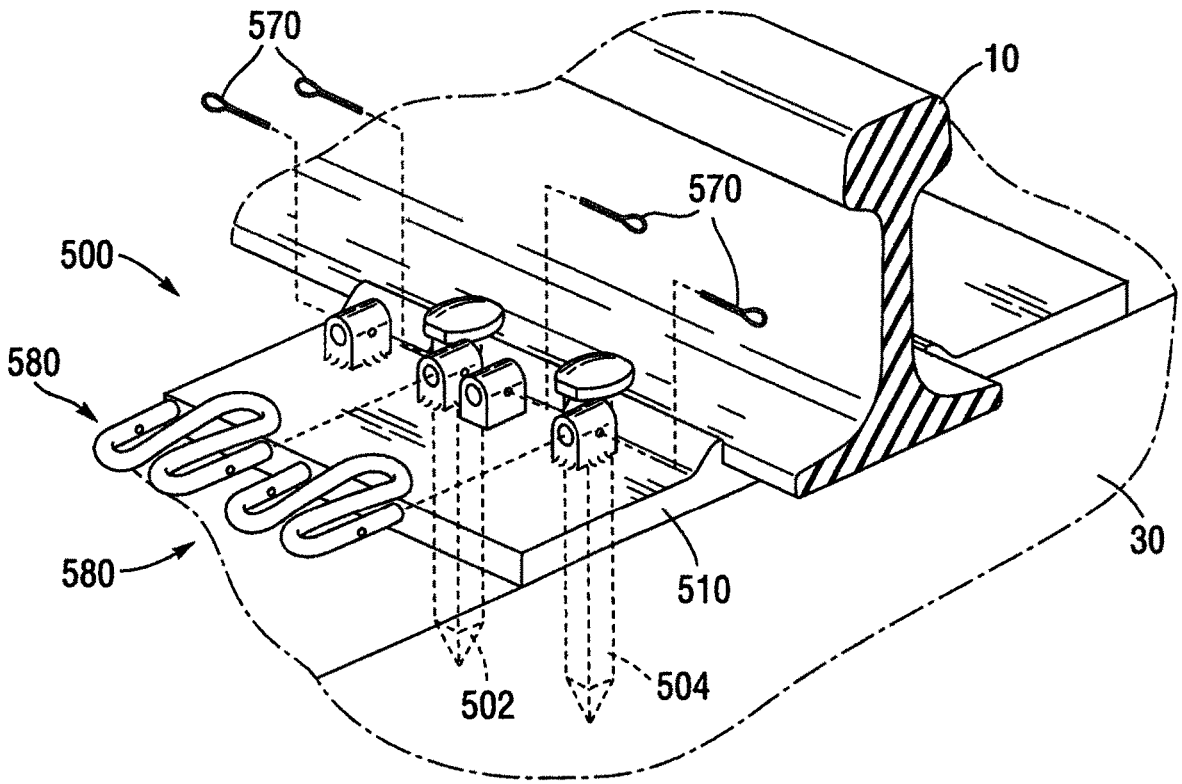
FIG. 25A is an upper perspective view of another spring clip tie plate with w spring clip(s) about to be attached in a fifth embodiment.

FIG. 25A is an upper perspective view of another spring clip tie plate 520 with w spring clip(s) 580 about to be attached in a fifth embodiment 500.

Figure 25B:
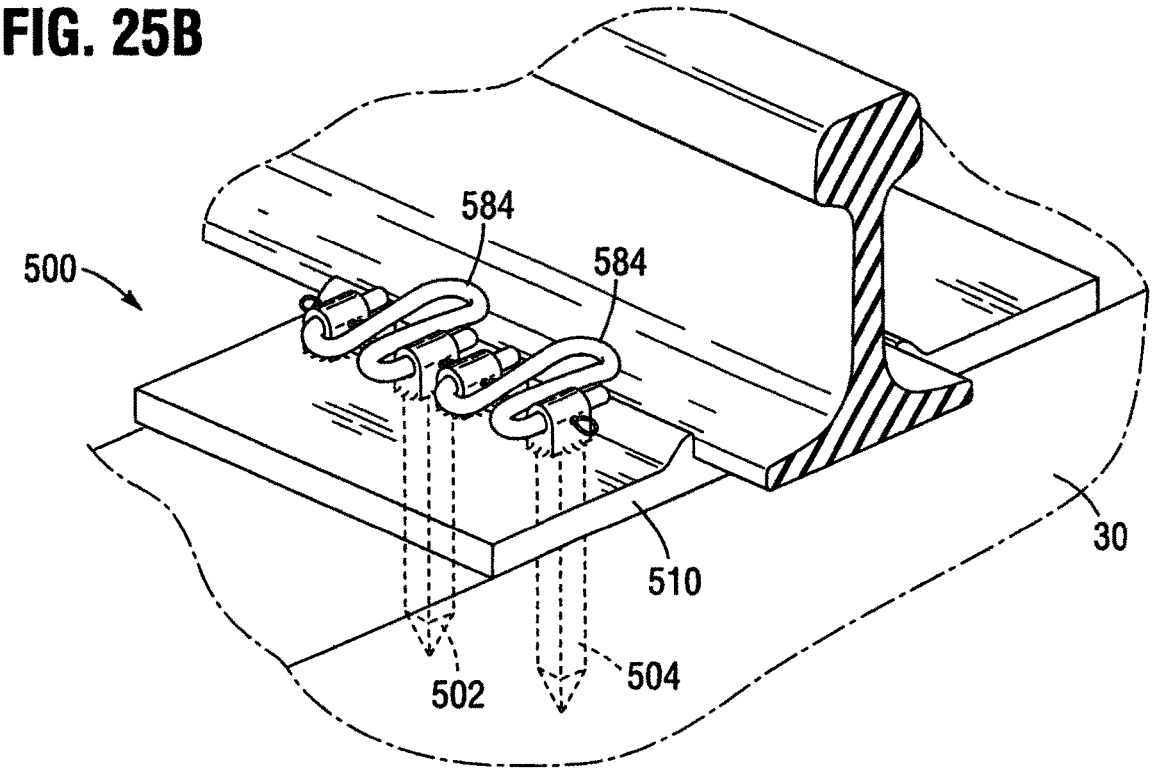
FIG. 25B is an upper perspective view of FIG. 25A with the w spring clip(s) assembled with the spring clip tie plate retaining the spikes.

FIG. 25B is an upper perspective view of FIG. 25A with the w spring clip(s) 580 assembled with the spring clip tie plate 510 retaining the spikes 502, 504.

Figure 26:
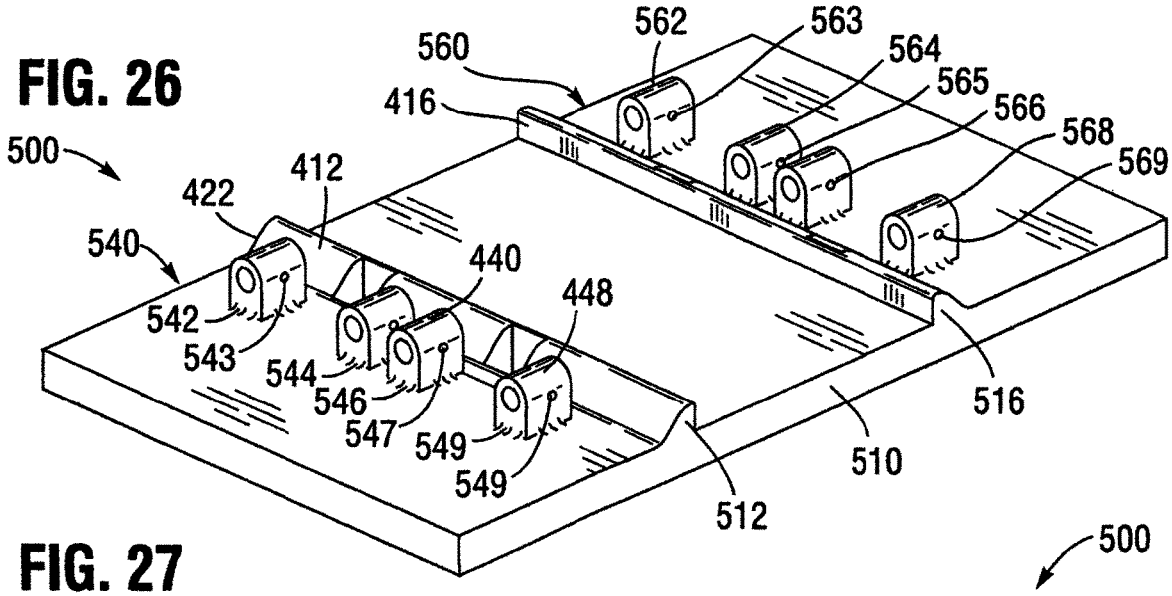
FIG. 26 is an upper perspective view of a fifth embodiment of the spring clip tie plate of FIG. 25B.
Figure 27:
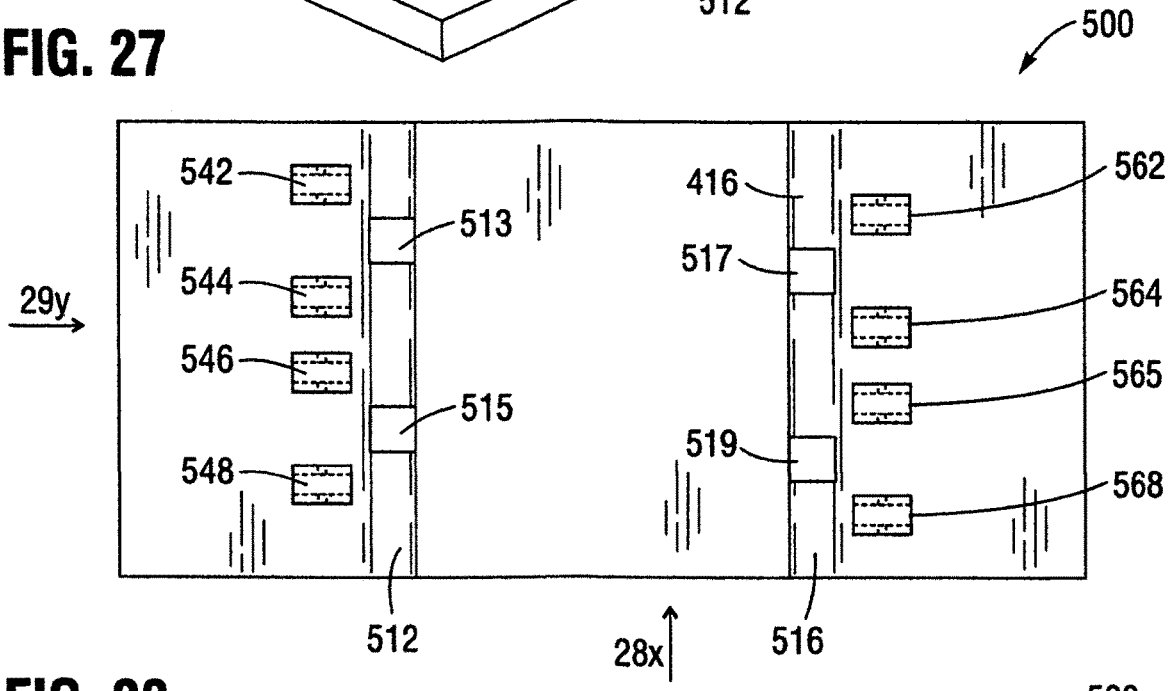
FIG. 27 is a top view of the spring clip tie plate of FIG. 26.
Figure 28:
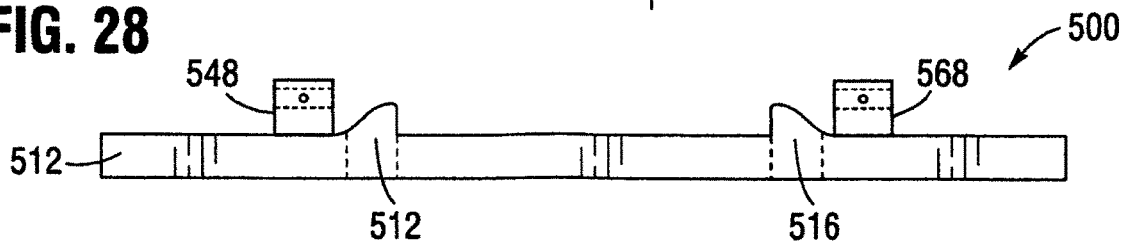
FIG. 28 is a side view of the spring clip tie plate of FIG. 27 along arrow 28X.
Figure 29:
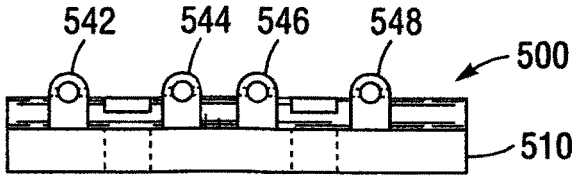
FIG. 29 is a front end view of the spring clip tie plate of FIG. 27 along arrow 29Y.

FIG. 26 is an upper perspective view of a fifth embodiment 500 of the spring clip tie plate 510 of FIG. 25B. FIG. 27 is a top view of the spring clip tie plate 510 of FIG. 26. FIG. 28 is a side view of the spring clip tie plate 520 of FIG. 27 along arrow 28X. FIG. 29 is a front end view of the spring clip tie plate 510 of FIG. 27 along arrow 29Y.

Figure 30A:
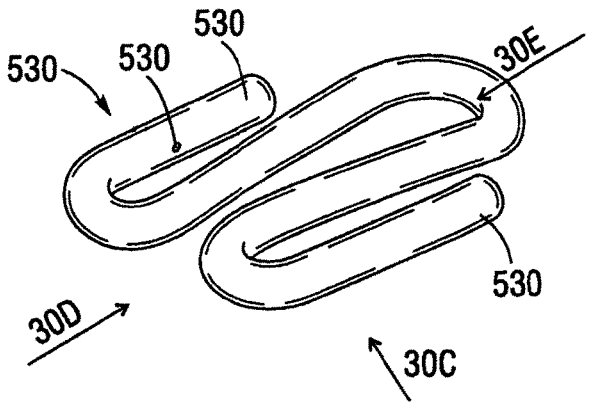
FIG. 30A is an upper perspective view of a w spring clip used in FIGS. 25A-25B.
Figure 30B:
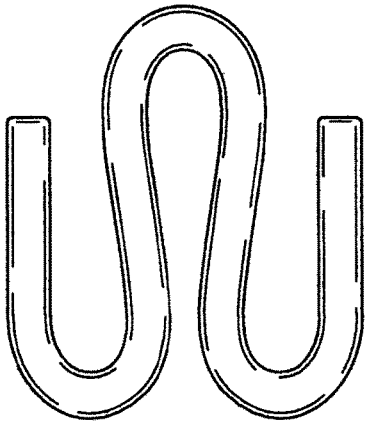
FIG. 30B is a top view of the w spring clip of FIG. 30A.
Figure 30C:
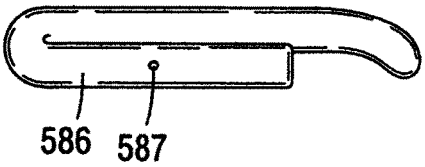
FIG. 30C is a side view of the w spring clip of FIG. 30A along arrow 30C.
Figure 30D:
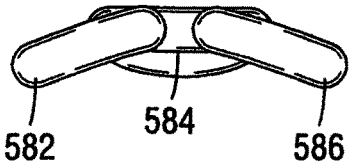
FIG. 30D is a front view of the w spring clip of FIG. 30A along arrow 30D.
Figure 30E:
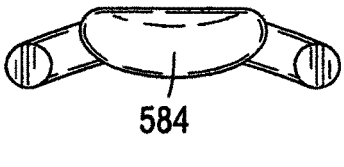
FIG. 30E is a rear view of the w spring clip of FIG. 30A along arrow 30E.

FIG. 30A is an upper perspective view of a w spring clip 580 used in FIGS. 25A-25B. FIG. 30B is a top view of the w spring clip 580 of FIG. 30A. FIG. 30C is a side view of the w spring clip 580 of FIG. 30A along arrow 30C. FIG. 30D is a front view of the w spring clip 580 of FIG. 30A along arrow 30D. FIG. 30E is a rear view of the w spring clip 580 of FIG. 30A along arrow 30E.

Referring to FIGS. 25A-30E, the fifth embodiment 500 can include a metal tie plate 510, with a first elongated ridge 512 running parallel to a second elongated ridge 516. A first spike hole 513 and a second spike hole 515 pass through the first elongated ridge 512, and a third spike hole 517 and fourth spike hole 519 pass through the second elongated ridge 516.

A plurality of spaced apart left metal structures 540 can be fixed to the tie plate 510 adjacent to the first elongated ridge 512. The plurality of left metal structures 540 can be welded and/or forged to the metal tie plate 510.

In this preferred embodiment, the plurality of spaced apart left metal structures 540 can include a first left metal structure 542 with side through-hole 543, second left metal structure 544 with side through-hole 545, third left metal structure 546 with side through-hole 547, and fourth left metal structure 548 with side through-hole 549. Each of the left metal structures 540 having horizontal channel openings substantially parallel with each other. The horizontal channel openings of each of the plurality of spaced apart left metal structures 540 having longitudinal axes, substantially perpendicular to the first elongated ridge 512.

The w shaped spring clip 580 can include a first leg 582, with side through-hole 583, a bent mid portion 584, and a second leg 586 with side through-hole 587.

The installer can insert the legs 582, 586 of one spring clip 580 into the horizontal channel openings of a pair of metal structures 542, 544. Another spring clip 580 can have its' legs 582, 586 into the horizontal channel openings of a second pair of metal structures 546, 548.

The spring clips 580 can be locked to respective metal structures 542, 544 by one of the coffer pins 570 passing through a side through-hole 543 in a first left metal structure 542 and through a side through-hole 583 in the first leg 528 of the spring clip 580. Another one of the cotter pins 570 can be passed through a side through-hole 545 in a second left metal structure 544 and through a side through-hole 587 in a second leg 586 of the spring clip 580. Another spring clip 580 can be locked to a second pair of metal structures 546 and 548 with another one of the cotter pins 570 passing through adjacent through-holes 547 583 and adjacent through-holes 549, 587.

A plurality of spaced apart right metal structures 560 can be fixed to the tie plate 510 adjacent to the second elongated ridge 516. The plurality of right metal structures 560 can be welded and/or forged to the metal tie plate 510.

In this preferred embodiment, the plurality of spaced apart right metal structures 560 can include a first right metal structure 562 with side through-hole 563, second right metal structure 564 with side through-hole 565, third right metal structure 566 with side through-hole 567, and fourth left metal structure 568 with side through-hole 569. Each of the right metal structures 560 having horizontal channel openings substantially parallel with each other. The horizontal channel openings of each of the plurality of spaced apart right metal structures 560 having longitudinal axes substantially perpendicular to the second elongated ridge 516. Each of the plurality of right metal structures 560 can include a first right metal structure 562 with side through-hole 563, second right metal structure 564 with side through-hole 565, third right metal structure 566 with side through-hole 567 and fourth right metal structure 568 with side through-hole 569.

Another set of spring clips 580 can be locked into the horizontal channel openings of the plurality of right metal structures 560 with additional cotter pins 570 in a similar manner to the cotter pins 570 used with the left plurality of metal structures 540.

The bent midportions 584 of each spring clip 580 is pushed over a portion of each head of the spikes 502, 504 retaining the spikes 502, 504 in place.

The bent midportions 584 of each spring clip 580 is pushed over a portion of each head of the spikes 502, 504 retaining the spikes 502, 504 in place. FIG. 25B shows the bent midportion 584 of the spring clip 580 pushed over the heads of the spikes 502, 504.

Sixth Embodiment

Figure 31A:
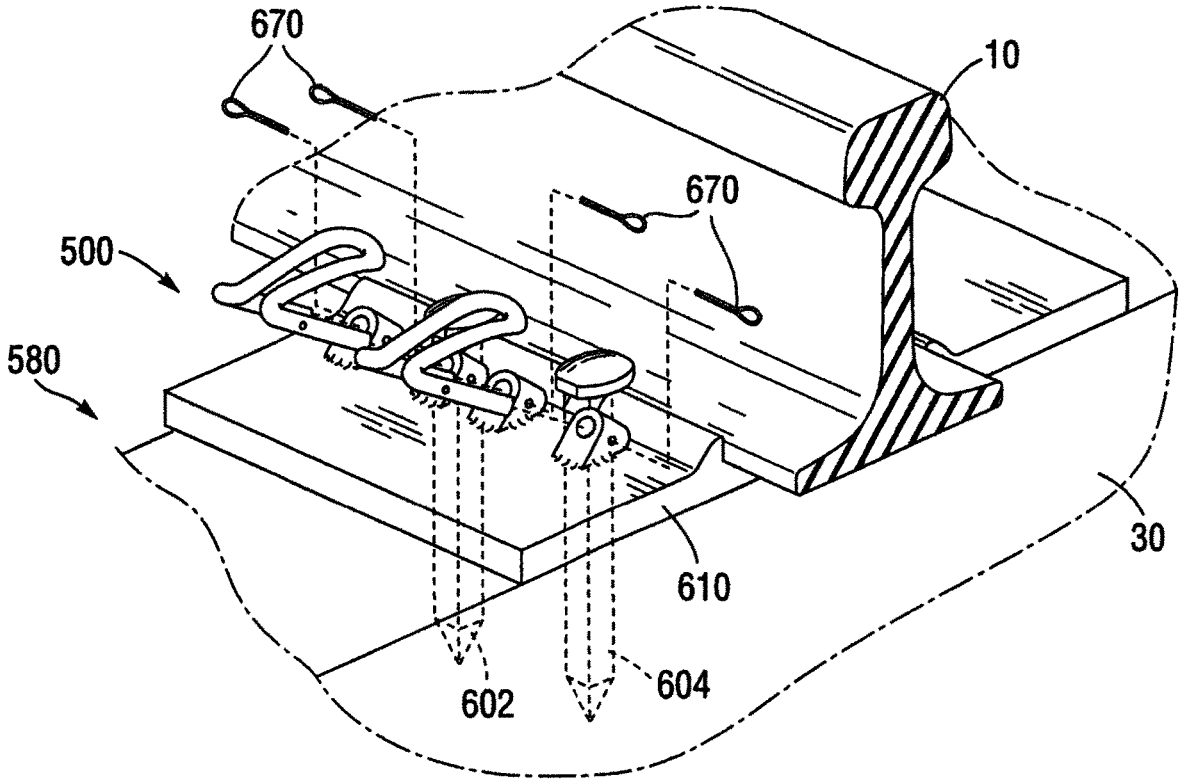
FIG. 31A is an upper perspective view of another spring clip tie plate with w spring clip(s) about to be attached in a sixth embodiment.
Figure 31B:
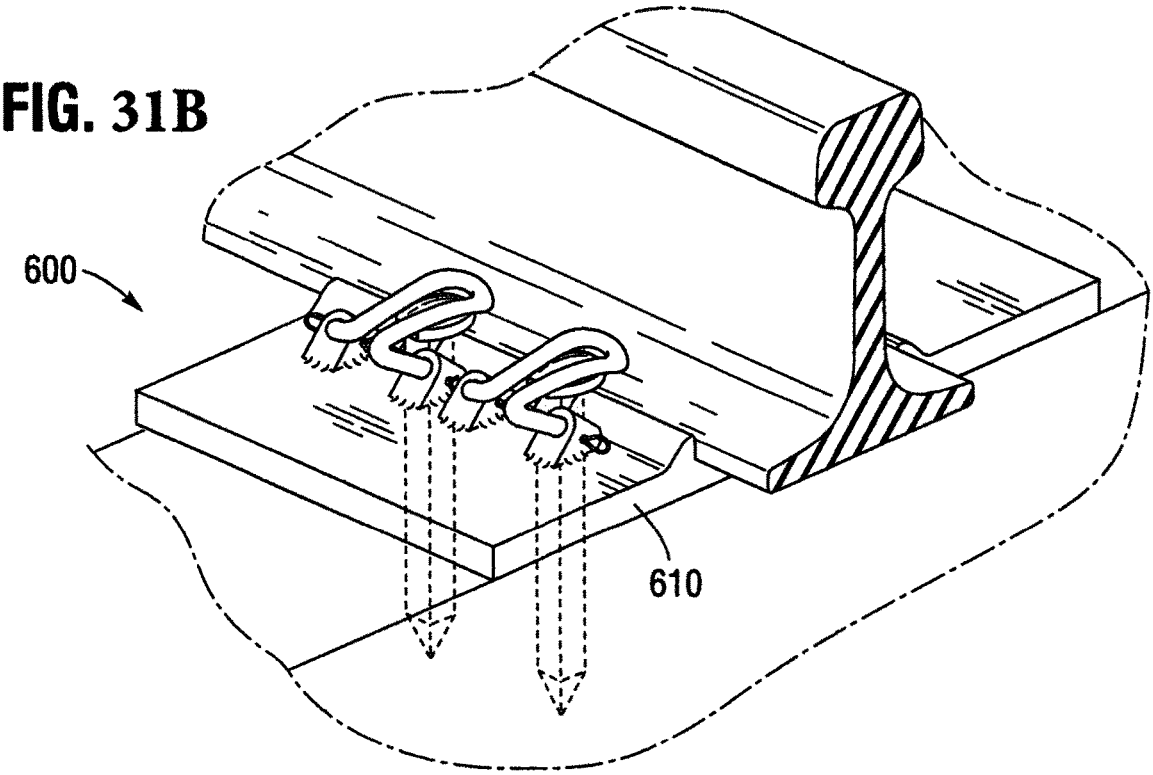
FIG. 31B is an upper perspective view of FIG. 31A with the w spring clip(s) assembled with the spring clip tie plate retaining the spikes.
Figure 32:
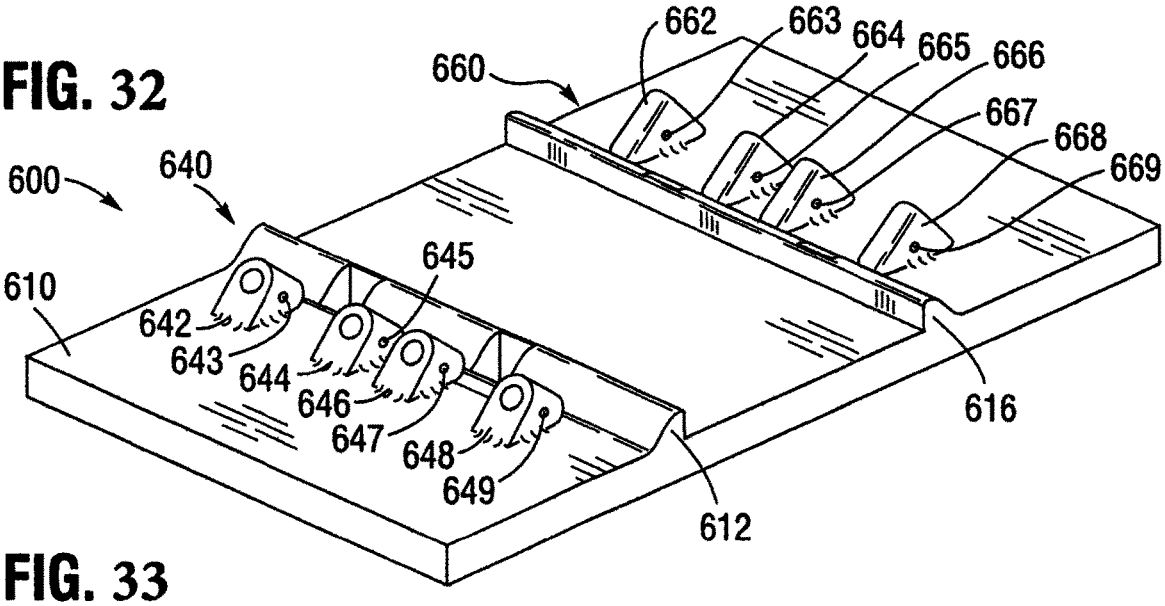
FIG. 32 is an upper perspective view of a sixth embodiment of the spring clip tie plate of FIG. 31B.

FIG. 31A is an upper perspective view of another spring clip tie plate 620 with w spring clip(s) 680 about to be attached in a sixth embodiment 600. FIG. 31B is an upper perspective view of FIG. 31A with the w spring clip(s) 680 assembled with the spring clip tie plate 610 retaining the spikes 602, 604. FIG. 32 is an upper perspective view of a sixth embodiment 600 of the spring clip tie plate 610 of FIG. 31B.

Figure 33:
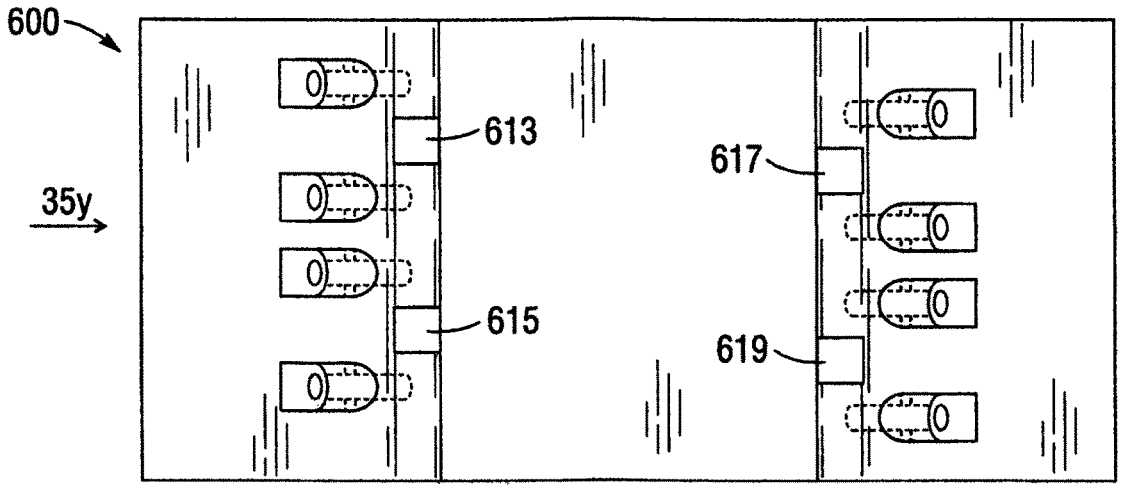
FIG. 33 is a top view of the spring clip tie plate of FIG. 32.
Figure 34:
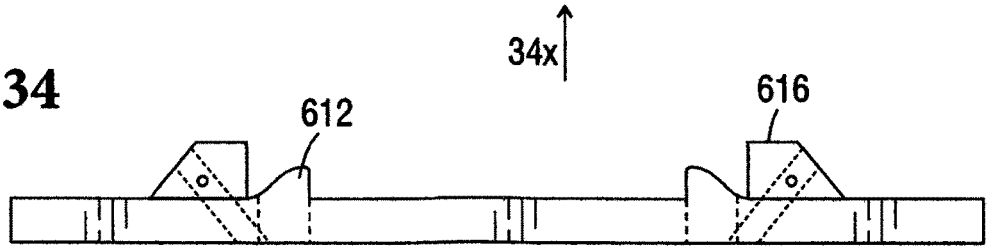
FIG. 34 is a side view of the spring clip tie plate of FIG. 33 along arrow 34X.
Figure 35:
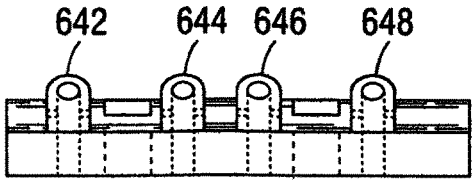
FIG. 35 is a front end view of the spring clip tie plate of FIG. 33 along arrow 35Y.

FIG. 33 is a top view of the spring clip tie plate 610 of FIG. 32. FIG. 34 is a side view of the spring clip tie plate 610 of FIG. 33 along arrow 34X. FIG. 35 is a front end view of the spring clip tie plate 610 of FIG. 33 along arrow 35Y.

Figure 36A:
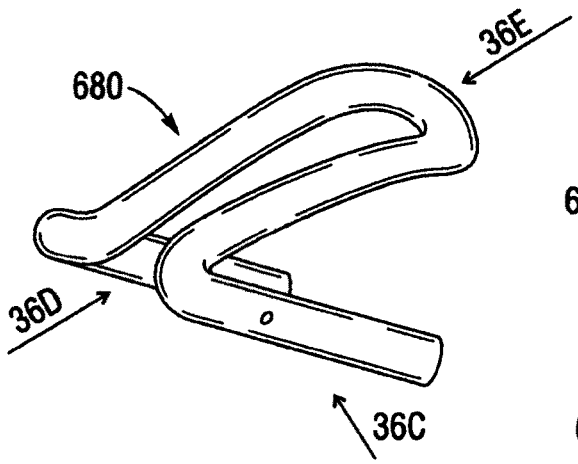
FIG. 36A is an upper perspective view of a w spring clip used in FIGS. 31A-31B.
Figure 36B:
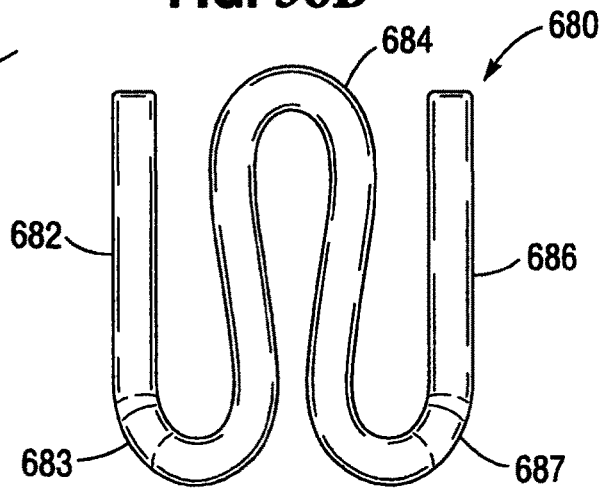
FIG. 36B is a top view of the w spring clip of FIG. 36A.
Figure 36C:
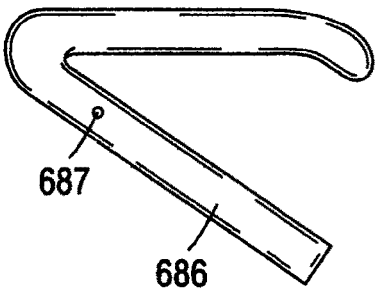
FIG. 36C is a side view of the w spring clip of FIG. 36A along arrow 36C.
Figure 36D:
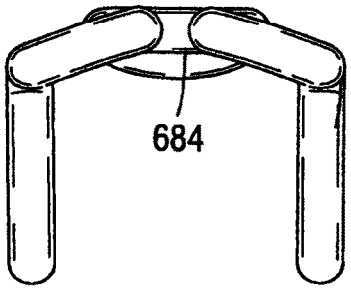
FIG. 36D is a front view of the w spring clip of FIG. 36A along arrow 36D.
Figure 36E:
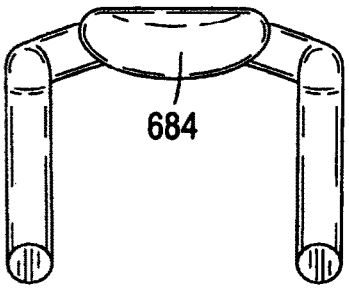
FIG. 36E is a rear view of the w spring clip of FIG. 36A along arrow 36E.

FIG. 36A is an upper perspective view of a w spring clip 680 used in FIGS. 31A-31B. FIG. 36B is a top view of the w spring clip 680 of FIG. 36A. FIG. 36C is a side view of the w spring clip 680 of FIG. 36A along arrow 36C. FIG. 36D is a front view of the w spring clip 680 of FIG. 36A along arrow 36D. FIG. 36E is a rear view of the w spring clip 680 of FIG. 36A along arrow 36E.

Referring to FIGS. 31A-36E, the sixth embodiment 600 can include a metal tie plate 610, with a first elongated ridge 612 running parallel to a second elongated ridge 616. A first spike hole 613 and a second spike hole 615 pass through the first elongated ridge 612, and a third spike hole 617 and fourth spike hole 619 pass through the second elongated ridge 616.

A plurality of spaced apart left metal structures 640 can be fixed to the tie plate 610 adjacent to the first elongated ridge 612. The plurality of left metal structures 640 can be welded and/or forged to the metal tie plate 610.

In this preferred embodiment, the plurality of spaced apart left metal structures 640 can include a first left metal structure 642 with side through-hole 643, second left metal structure 644 with side through-hole 645, third left metal structure 646 with side through-hole 647, and fourth left metal structure 648 with side through-hole 649. Each of the left metal structures 640 having angled channel openings substantially parallel with each other. The angle channel openings of each of the plurality of spaced apart left metal structures 640 having longitudinal axes substantially perpendicular to the first elongated ridge 612.

The w shaped spring clip 680 can include a first leg 682, with side through-hole 683, a bent mid portion 684, and a second leg 686 with side through-hole 687.

The installer can insert the legs 682, 686 of one spring clip 680 into the angled channel openings of a pair of metal structures 642, 644. Another spring clip 680 can have its' legs 682, 686 into the angled channel openings of a second pair of metal structures 646, 648.

The spring clips 680 can be locked to respective metal structures 642, 644 by one of the cotter pins 670 passing through a side through-hole 543 in a first left metal structure 542 and through a side through-hole 583 in the first leg 528 of the spring clip 580. Another one of the cotter pins 570 can be passed through a side through-hole 645 in a second left metal structure 644 and through a side through-hole 687 in a second leg 686 of the spring clip 680. Another spring clip 680 can be locked to a second pair of metal structures 646 and 648 with another pair of cotter pins 570 passing through adjacent through-holes 647 683 and adjacent through-holes 649, 687.

A plurality of spaced apart right metal structures 660 can be fixed to the tie plate 610 adjacent to the second elongated ridge 616. The plurality of right metal structures 660 can be welded and/or forged to the metal tie plate 610.

In this preferred embodiment, the plurality of spaced apart right metal structures 660 can include a first right metal structure 662 with side through-hole 663, second right metal structure 664 with side through-hole 665, third right metal structure 666 with side through-hole 667, and fourth left metal structure 668 with side through-hole 669. Each of the right metal structures 660 having angled channel openings substantially parallel with each other. The angled channel openings of each of the plurality of spaced apart right metal structures 660 having longitudinal axes, substantially perpendicular to the second elongated ridge 616. Each of the plurality of right metal structures 660 can include a first right metal structure 662 with side through-hole 663, second right metal structure 664 with side through-hole 665, third right metal structure 666 with side through-hole 667 and fourth right metal structure 668 with side through-hole 669.

Another set of spring clips 680 can be locked into the angled channel openings of the plurality of right metal structures 660 with additional cotter pins 670 in a similar manner to the cotter pins 670 used with the left plurality of metal structures 640.

The bent midportions 684 of each spring clip 680 is pushed over a portion of each head of the spikes 602, 604 retaining the spikes 602, 604 in place. FIG. 31B shows the bent midportion 684 of the spring clip 680 pushed over the heads of the spikes 602, 604.

Although the embodiments show the use of pins, such as cotter pins being used, other types of fasteners, such as but not limited to screws with or without nuts and washers, and the like can also be used.

While the above embodiments describe attaching base plates to tie plates, and attaching metal brackets and metal parts to metal tie plates by welding, other types of attachment techniques can be used, such as but not limited to mechanical attachments, and any other way of forming attachments, such as but not limited to forging, and the like.

The w spring clips can further be attached to mechanical structures shown and described in U.S. Pat. No. 5,520,330 to Brown et al., which is incorporated by reference.

While the embodiments show and describe retaining railroad spikes to rail ties, the embodiments can be used to retain railroad screw shaped spikes to rail ties.

Although fasteners, such as nuts and washers are shown and described, other types of fasteners can be used, such as but not limited to locking washers, and the like. Parts can be attached together by welding, forging, heating with and without hydraulic presses and the like.

While some embodiments reference using upwardly protruding studs with threaded ends for nuts to attach metal plates to the metal tie plate, other techniques can be used to fasten metal parts together.

For example, an upwardly protruding rod without a threaded end can be used where the rod is heated and a hydraulic press compresses the upper end forming a head attaching a horizontal plate to the tie plate. See for example, FIG. 19B, and any where nuts and washers were referenced.

The upwardly protruding rod can initially be a stud with a head on one end that is pushed up through holes in the tie plate, and the head of the stud can be welded to the undersurface of the tie plate. Afterward a horizontal plate can be attached to the tie plate as previously described.

This new railroad tie plate invention is very important to the safety of the railroad industry. Currently rail spikes are constantly coming out and with the constant pounding of the freight trains no method of keeping them in exists.

Lag screws are also prone to coming loose and this causes the rail gauge too separate causing train derailments.

A Global rail infrastructure company sees the value in this invention.

It could save countless lives and many millions of dollars in damage caused by train derailments.

Although specific advantages have been enumerated above, various embodiments may include some, none, or all of the enumerated advantages.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A railroad spike retention system for retaining spikes to rail ties, comprising:

a metal tie plate with a plurality of through-holes for railroad spikes, the metal tie plate having an top surface facing upward, and a bottom surface facing downward; and at least one metal structure attached to the upper surface of the tie plate having a portion that covers a head portion of each railroad spike for preventing each railroad spike from coming out, wherein the portion that covers the head portion of a railroad spike includes:

a plurality of w shaped spring clips.

2. A railroad spike retention system for retaining spikes to rail ties, comprising:

a metal tie plate with a plurality of through-holes for railroad spikes, the metal tie plate having an top surface facing upward, and a bottom surface facing downward; and at least one metal structure attached to the upper surface of the tie plate having a portion that covers a head portion of each railroad spike for preventing each railroad spike from coming out, wherein the at least one metal structure is welded to the upper surface of the tie plate.

3. A railroad spike retention system for retaining spikes to rail ties, comprising:

a metal tie plate with a plurality of through-holes for railroad spikes, the metal tie plate having an top surface facing upward, and a bottom surface facing downward; and at least one metal structure attached to the upper surface of the tie plate having a portion that covers a head portion of each railroad spike for preventing each railroad spike from coming out, wherein the at least one metal structure includes a box holder with an opening.

4. A railroad spike retention system for retaining spikes to rail ties, comprising:

a metal tie plate with a plurality of through-holes for railroad spikes, the metal tie plate having an top surface facing upward, and a bottom surface facing downward; and at least one metal structure attached to the upper surface of the tie plate having a portion that covers a head portion of each railroad spike for preventing each railroad spike from coming out, wherein the at least one metal structure includes metal structure with horizontal channel opening.

5. A railroad spike retention system for retaining spikes to rail ties, comprising:

a metal tie plate with a plurality of through-holes for railroad spikes, the metal tie plate having an top surface facing upward, and a bottom surface facing downward; and at least one metal structure extending upward from sides of the upper surface of the tie plate having a portion that covers a head portion of each railroad spike for preventing each railroad spike from coming out, wherein the portion that covers the head portion of a railroad spike includes:

a plurality of w shaped spring clips.

6. A railroad spike retention system for retaining spikes to rail ties, comprising:

a metal tie plate with a plurality of through-holes for railroad spikes, the metal tie plate having an top surface facing upward, and a bottom surface facing downward; and at least one metal structure extending upward from sides of the upper surface of the tie plate having a portion that covers a head portion of each railroad spike for preventing each railroad spike from coming out, wherein the at least one metal structure includes: a pair of metal brackets.

7. The railroad spike retention system of claim 6, further comprising:

an elongated rod extending between the pair of metal brackets.

8. A railroad spike retention system for retaining spikes to rail ties, comprising:

a metal tie plate with a plurality of through-holes for railroad spikes, the metal tie plate having an top surface facing upward, and a bottom surface facing downward; and at least one metal structure extending upward from sides of the upper surface of the tie plate having a portion that covers a head portion of each railroad spike for preventing each railroad spike from coming out, wherein the at least one metal structure includes: a pair of metal studs.

9. The railroad spike retention system of claim 8, further comprising:

a metal plate extending between the pair of metal studs.

10. A railroad spike retention system for retaining spikes to rail ties, comprising:

a metal tie plate with a plurality of through-holes for railroad spikes, the metal tie plate having a top surface facing upward, and a bottom surface facing downward;

inverted L shape brackets attached to the upper surface of the tie plate; and a member with a portion that covers a head portion of each railroad spike for preventing each railroad spike from coming out.

11. The railroad spike retention system of claim 10, wherein the member with the portion that covers the head portion of a railroad spike includes:

a plurality of w shaped spring clips.

12. The railroad spike retention system of claim 10, further comprising:

a horizontal plate attaching the inverted L shape brackets to the top surface of the tie plate.

13. The railroad spike retention system of claim 12, wherein the horizontal plate is welded to the top surface of the tie plate.

14. The railroad spike retention system of claim 12, wherein the horizontal plate is forged to the top surface of the tie plate.

15. The railroad spike retention system of claim 12, further comprising:

studs extending upward from the top surface of the tie plate having upper threaded ends for attaching the horizontal plate to the tie plate.

16. The railroad spike retention system of claim 12, further comprising:

studs extending upward from the top surface of the tie plate, the studs having upper ends forged to the horizontal plate.

17. A railroad spike retention system for retaining spikes to rail ties, comprising:

a base plate fixedly attached to a rail road tie plate; and at least one w shaped spring clip, where said baseplate holds and locks said w shaped spring Clip in place, and a portion of the w shaped spring clip extends over a top portion of a railroad spike head.

18. The railroad spike retention system of claim 17, wherein the at least one w shaped spring clip includes:

a plurality of w shaped spring clips.

* * * * *